US010745907B1

(12) United States Patent
Canby

(10) Patent No.: US 10,745,907 B1
(45) **Date of Patent: *Aug. 18, 2020**

(54) ROLLING BLOCK RESTRAINT CONNECTOR FOR EXTERNAL RESTRAINT MOMENT CONNECTIONS

(71) Applicant: Timothy William Canby, Irvine, CA (US)

(72) Inventor: Timothy William Canby, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/357,173

(22) Filed: Mar. 18, 2019

Related U.S. Application Data

(63) Continuation-in-part of application No. 16/173,149, filed on Oct. 29, 2018, now abandoned, which is a (Continued)

(51) Int. Cl.
*E04B 1/41* (2006.01)
*E04B 1/18* (2006.01)
(Continued)

(52) U.S. Cl.
CPC ..... *E04B 1/40* (2013.01); *E04B 1/185* (2013.01); *E04B 1/2403* (2013.01);
(Continued)

(58) Field of Classification Search
CPC ..... E04B 1/40; E04B 1/185; E04B 1/2403; E04B 1/2604; E04B 2001/2616;
(Continued)

(56) References Cited

U.S. PATENT DOCUMENTS 949,394 A * 2/1910 Daly ..... E04B 1/2403 403/173
3,178,780 A * 4/1965 Booher ..... F16B 5/02 403/260

(Continued)

FOREIGN PATENT DOCUMENTS

EP 2492408 A1 * 8/2012 ..... E04B 1/2604
GB 2066892 A * 7/1981 ..... F16B 2/12
WO WO-2016051388 A1 * 4/2016 ..... E04B 1/2604

*Primary Examiner* — Theodore V Adamos
(74) *Attorney, Agent, or Firm* — Rutan & Tucker, LLP; Kyle M. St. James

(57) ABSTRACT

A rolling block restraint connector for forming a moment resisting connection at a joint intersection between a continuous column and at least a first continuous beam that intersects the continuous column is disclosed. The connector includes a first restraint assembly, a second restraint assembly, wherein the second restraint assembly is configured to be located diagonally across the joint intersection from the first restraint assembly, a first linkage that couples the first restraint assembly with the second restraint assembly, the first linkage including (i) a first saddle configured to couple with an exterior of a first end of a first tubular shaft of the first restraint assembly, and (ii) a second saddle configured to couple with an exterior of a first end of a second tubular shaft of the second restraint assembly, and a second linkage that couples the first restraint assembly with the second restraint assembly.

20 Claims, 13 Drawing Sheets

Related U.S. Application Data continuation of application No. 15/629,570, filed on Jun. 21, 2017, now Pat. No. 10,113,307.

(51) Int. Cl.

| | |
|---|---|
| ***E04B 1/26*** | (2006.01) |
| ***E04B 1/24*** | (2006.01) |
| ***E04G 23/02*** | (2006.01) |
| ***E04H 9/02*** | (2006.01) |

(52) U.S. Cl.

CPC ..... *E04B 1/2604* (2013.01); *E04G 23/0218* (2013.01); *E04H 9/023* (2013.01); *E04H 9/024* (2013.01); *E04B 2001/243* (2013.01); *E04B 2001/2415* (2013.01); *E04B 2001/2424* (2013.01); *E04B 2001/2439* (2013.01); *E04B 2001/2448* (2013.01); *E04B 2001/2457* (2013.01); *E04B 2001/2496* (2013.01); *E04B 2001/2616* (2013.01); *E04B 2001/2644* (2013.01); *E04B 2001/2672* (2013.01); *E04B 2001/2692* (2013.01); *E04B 2001/2696* (2013.01)

(58) Field of Classification Search

CPC ..... E04B 2001/243; E04B 2001/2439; E04B 2001/2448; E04B 2001/2457; E04B 2001/2496; E04B 2001/2415; E04B 2001/2644; E04B 2001/2672; E04B 2001/2692; E04B 2001/2696; E04B 2001/2424; E04H 9/023; E04H 9/024; E04G 23/0218

See application file for complete search history.

(56) References Cited

U.S. PATENT DOCUMENTS

| | | | | |
|---|---|---|---|---|
| 6,609,343 | B1 * | 8/2003 | Litten | A63B 71/023 248/228.5 |
| 9,909,300 | B2 * | 3/2018 | Miller | E04B 1/2403 |
| 2014/0332659 | A1 * | 11/2014 | Tichell Fortea | E21D 11/08 249/175 |
| 2017/0268220 | A1 * | 9/2017 | Miller | E04B 1/2403 |

* cited by examiner

ROLLING BLOCK RESTRAINT CONNECTOR FOR EXTERNAL RESTRAINT MOMENT CONNECTIONS

CROSS-REFERENCE TO RELATED APPLICATION

This patent application is a continuation-in-part application of U.S. patent application Ser. No. 16/173,149 filed Oct. 29, 2018, and titled "IMPROVED ROLLING BLOCK RESTRAINT CONNECTOR," which is a continuation application of U.S. patent application Ser. No. 15/629,570 filed Jun. 21, 2017, and titled "ROLLING BLOCK RESTRAINT CONNECTOR," now U.S. Pat. No. 10,113,307 issued Oct. 30, 2018, the entire contents of all of which are incorporated herein by reference.

FIELD

The present invention relates to connectors used for making connections by external restraint of members at joints where structural framing members cross and in particular, a joint which resists relative rotation of the members at the connection, such connection being a moment resisting rigid connection which allows different structural configurations to be made and has greater load capacity and with less deflection than simply supported connections.

GENERAL BACKGROUND

Connections are formed and made to hold the structural framing members together to build physical structures such as walls, floors, roofs, towers, bridges, toys, and furniture. Various methods are utilized to form and make connections at the joints where structural framing members cross. Rigid moment connection joints made by processes such as welding, bolting or gluing are time consuming, complicated to make and need to be specifically designed on a case by case basis for the specific materials, size and sectional shapes to be joined. A connector that relies on external forces applied to the outside surface of structural members provides a moment resisting rigid connection independent of size, sectional shape and material joined. Such a connection would be highly valued to the general public for use as an element for structural framing and, in particular, for wood member connections.

Current RBR connectors that utilizing single-rod linkage are not clamped together laterally as a block shaft of an RBR connector has a linkage rod inserted through an aperture of the block shaft that acts as an obstruction for any clamping device. Additionally, the presence of an aperture in the block shaft weakens the block shaft, is difficult to properly fabricate, makes the block shaft usable for only one configuration and with the linkage rod installed obstructs the inside of the block shaft for lateral passage of a threaded rod. The disclosure presents an alternative to a RBR connector that utilizes a single-rod linkage.

BRIEF DESCRIPTION OF THE DRAWINGS

One or more embodiments of the present disclosure are illustrated by way of example and not limitation in the figures of the accompanying drawings, in which like references indicate similar elements.

DETAILED DESCRIPTION

Figure 1A:
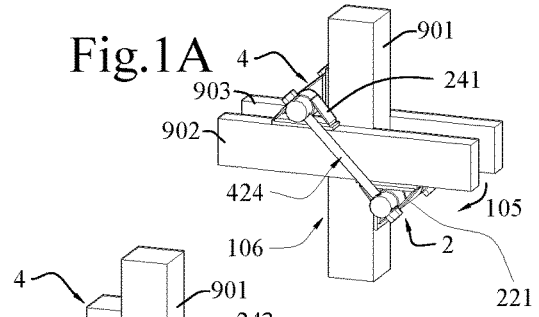
FIG. 1A shows a first embodiment of a pin-less single RBR connector joining rectangular member.

Some structural member connection types may be referred to as "pinned," which generally means the members are free to rotate. Other structural member connection types may be referred to as moment resisting rigid connections, by which the members are restrained from rotation at the point where they cross and transmit a bending moment through the joint connection. Typical moment resisting rigid connections use a combination of fasteners including screws, bolts, rivets, glue, welding, rods, inserts and/or plates installed at the joint to restrict the rotation and transfer the moment from one member through the connection. These types of connections are time consuming, complicated to make and need to be specifically designed on a case by case basis for the specific materials, size and sectional shapes to be joined and reduce member strength in way of the joint. In contrast, this disclosure provides for a moment resisting rigid connection using a connector that exerts external surface force and thus maintains full member section and strength in way of the joint to eliminate need for supplemental strengthening. Herein, in one embodiment, a rolling block restraint (RBR) connector is disclosed that provides rigid restraint to the external surface of a structural member connection.

In a second embodiment, a RBR connector is disclosed that provides a multi-rod linkage component (e.g., a two-rod linkage component) configured between block shafts of the RBR connector. In yet another embodiment, a RBR connector is disclosed that provides a transverse clamp configured to maintain a physical connectedness between members and connector blocks. In another embodiment, a RBR connector is disclosed that provides a two-axis moment frame that is formed using block shafts extending between portal frames. In some embodiments, a RBR connector is disclosed that provides a fixed-end beam apparatus for demonstrating moment resisting connections. In still other embodiments, a RBR connector is disclosed that provides a two-axis moment connector multi-level frame having four moment resisting members plus one vertical load carrying member at each column location.

A single RBR connector provides a moment resisting rigid connection in one direction. Double RBR connectors with a pin provides a moment resisting rigid connection in both directions such as for a wood moment resisting rigid frame. A RBR connector may be used in forming a connection for: (i) structures that are permanent or temporary, (ii) the erection of a structure, or (iii) the repair of a structure. The members and connections may be reusable. The RBR connector may be configured to restrain two, three, four or more members as shown in the accompanying figures.

As used herein, the terms "connector" is generally defined as a device and a "connection" may be the overall joint formed by the use of a connector to couple two or more structural framing members, that provides moment resisting rigid restraint at the intersection of structural framing members.

The term "member" broadly refers to a column or beam used in a physical structure. In some embodiments, horizontal members may be referred to as "beam(s)," and vertical members may be referred to as "column(s)." Further, column foundations may be pinned (e.g., generally free to rotate) but not shown.

The RBR connector is engineered and designed for joining intersecting (e.g., crisscrossing) structural members to provide adequate strength for the forces that will occur at the intersection angle.

I. Rolling Block Restraint Connector

A single RBR connector provides a moment resisting rigid connection in one direction. A double RBR connectors with a pin provides a moment resisting rigid connection in both directions such as for a wood moment resisting rigid frame. A RBR connector may be used in forming a connection for: (i) structures that are permanent or temporary, (ii) the erection of a structure, or (iii) the repair of a structure. The members and connections may be reusable. The RBR connector may be configured to restrain 2, 3, 4 or more members as shown in the accompanying figures.

Figure 2:
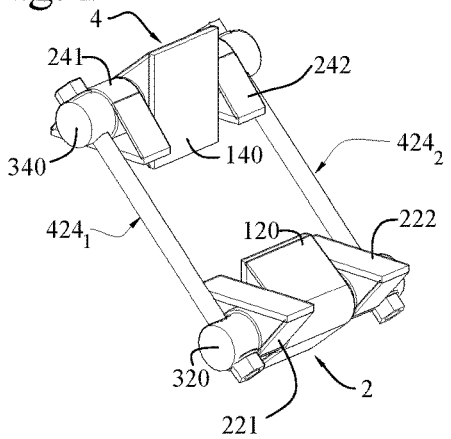
FIG. 2 shows a pressure block, shaft and linkage parts, assemblies and blow up.
Figure 3:
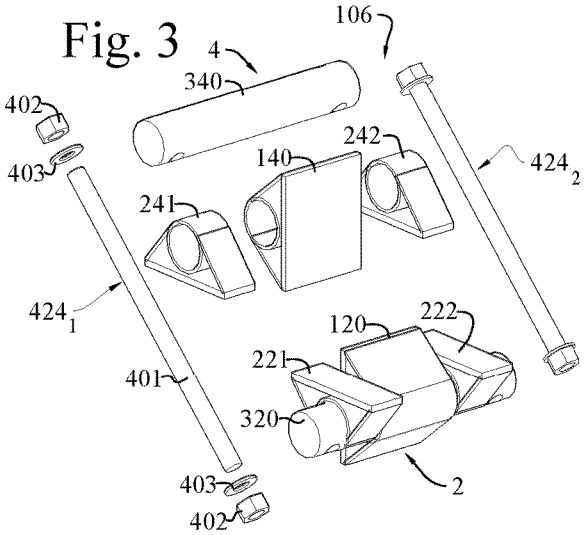
FIG. 3 shows an assembly of a single rolling block restraint (RBR) connector that provides restraint for one rotational direction.

In FIG. 1A, a three member single RBR connector 106 used to restrain main member (MM) 901, side members (SM) SM1 902 and SM2 903 for member forces in a first direction indicated by arrow 105 is shown. The single RBR connector 106 includes the block and shaft assemblies 2 and 4, and two rod linkages $\mathbf{424}_1$ and $\mathbf{424}_2$, as seen in FIGS. 2 and 3. Each of the block and shaft assemblies 2 and 4 includes a plurality of pressure blocks as illustrated in greater detail in, for example, FIGS. 2 and 3. Referring briefly to FIG. 2, the block and shaft assembly 2 is shown to include pressure blocks 221 and 222, which are configured to contact the SM1 902 and the SM2 903, and pressure block 120, which is configured to contact the MM 901. The block and shaft assembly 2 also includes pressure block shaft 320 that passes through a tubular channel (e.g., a cutout) of each of the pressure blocks 120, 221 and 222. Similarly, the block and shaft assembly 4 includes pressure blocks 241 and 242, which are configured to contact the SM1 902 and the SM2 903, pressure block 140, which is configured to contact the MM 901 and pressure block shaft 340 that passes through a tubular channel of each of the pressure blocks 140, 241 and 242. As is further illustrated in FIG. 2, the two rod linkages $\mathbf{424}_1$ and $\mathbf{424}_2$ couple the block and shaft assemblies 2 and 4 such that the pressure blocks 120 and 140 are aligned, the pressure blocks 221 and 241 are aligned, and the pressure blocks 222 and 242 are aligned.

Figure 1B:
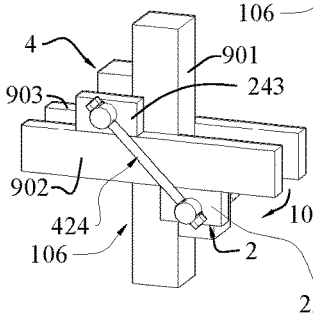
FIG. 1B shows a second embodiment of a pin-less single RBR connector joining rectangular member.

Now referring back to FIG. 1A, the single RBR connector 106 is configured to hold MM 901 and SM1 902 and SM2 903 in place when loaded provided the friction force is greater than external forces. Friction forces occur from the equal and opposite restoring couple forces pressing on the sides of SM1 902 and SM2 903 and MM 901 by the pressure blocks of block and shaft assemblies 2 and 4 and is proportional to the product of static coefficient of friction and the force reaction caused by the load at the point of contact. Additionally, the inward pressures are perpendicular to the surface and in the case of wood grain, this will and increase the strength against some modes of failure. A practical use for this pin-less configuration could be for providing lateral strength resistance when installed between two existing structural columns. Referring now to FIG. 1B, a second embodiment of a pin-less single RBR connector joining rectangular member is shown. The illustration of FIG. 1B illustrates block and shaft assemblies 2 and 4 having rectangular-shaped pressure blocks 243 and 223, in contrast to pressure blocks 241 and 221 of FIG. 1A that include a side having a curved shape.

Figure 4:
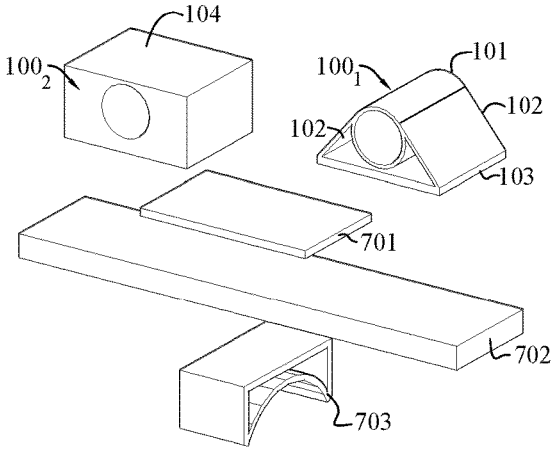
FIG. 4 shows a pressure block and pressure pad inserts.

As shown in FIG. 4, two examples of pressure block assemblies $\mathbf{100}_1$ and $\mathbf{100}_2$. The pressure block assembly $\mathbf{100}_1$ may include a tubular shaft housing 101, connected to two compression struts 102 that are attached to pressure pad 103. The pressure block $\mathbf{100}_2$ may be a single piece of stock and, in some embodiments, may include a tubular channel. The surface area of the pressure pad 103 and insert pad 701 are each sized to distribute acceptable non-crushing bearing pressure to MM 901, SM1 902 and SM2 903, illustrated in FIGS. 1, 5, 6 and 9-21 and discussed below, in order to maintain full sectional strength of these members at the connection when loaded. Component 702 represents an insert for increasing the section modulus and/or changing the characteristic of the joint, such as a length of steel strap to form a composite with wood, or flexible material like neoprene rubber to provide cushion or change coefficient of friction, or a material which will crush when a high load condition occurs to serve as a type of structural fuse. Component 703 represents an insert which has a flat face to interface (e.g., physically contact) with pressure plate 103, component 702, or component 703 and a face shaped to conform to MM 901, SM 902 or SM 903 (e.g., illustrated as a concave face) based on the shape of one MM 901, SM 902 or SM 903. The pressure block design for a wood rectangular member or a steel W section will be different because the bearing capacity of wood is much lower than steel and a steel member is stiffer in way of the webs which necessitates the block be made stronger in that area of bearing.

The pressure blocks 120, 140, 221, 222, 241 and 242 are made of any material such as steel, aluminum or plastic that withstands design loads and by any construction method such as cutting from a solid piece of material, casting, extrusion or fabrication of separate parts. Further, the pressure blocks 120, 140, 221, 222, 241 and 242 need not all be comprised of the same material. The type of block construction shown by $\mathbf{100}_1$ may be made with a gap between parts 101 and 103. A comparison of the gap measured in the unloaded and loaded condition may be used for estimating or calibrating block loading.

Referring to FIG. 3, an exploded view of the components used to form the single RBR connector 106 are shown. FIG. 3 illustrates the two pressure blocks 221 and 241 configured for coupling with SM1 902, two pressure blocks 120 and 140 configured for coupling with MM 901, and two pressure blocks 222 and 242 configured for coupling with SM2 903, pressure block shafts 320 and 340, and two adjustable threaded rod linkages 424. Pressure block shafts 320 and 340 may be solid or tubular such as pipe and have holes made at their ends which may be threaded to receive rod linkages $\mathbf{424}_1$ and $\mathbf{424}_2$. In one embodiment. The rod linkages $\mathbf{424}_1$ and $\mathbf{424}_2$ may be threaded. The pressure block shafts 320 and 340 are inserted through shaft housings 101 on each of the six pressure blocks 120, 140, 221, 222, 241 and 242 as shown in FIG. 2. Adjustable threaded rod linkages $\mathbf{424}_1$ and $\mathbf{424}_2$ include a threaded rod coupling 401, which may be, inter alia, a bolt or threaded rod, linkage nut 402, and linkage washer 403. Linkage washer 403 may be a flat washer or shaped washer that conforms to the shaft surface of contact. Alternatively, the rod linkages $\mathbf{424}_1$ and $\mathbf{424}_2$ may be solid bars and welded to the pressure block shafts 320 and 340 at the ends after the connection is tightened. The block and shaft assemblies 1, 2, 3, and 4 of FIG. 6 each includes three pressure blocks and one shaft corresponding to quadrant 1, 2, 3 and 4 of the connection. For example, assembly 2 is comprised of shaft 320 and pressure blocks 221, 120, and 222. The pressure blocks 221, 120, and 222 rotate freely on the shaft 320 and position the pressure pads 103 in alignment with the member surfaces. For example pressure block 241 rotates on shaft 340 and follows the deflected shape of SM1 as it is loaded. The pressure plate 103 is supported at the ends by compression struts 102 so deflection does not occur over the length of the plate between these supports. As a result, the pressure applied to the member is even and the entire surface of the plate is efficient and easily designed to transfer force less than the crushing strength of the material of the MM and/or SM.

Figure 5:
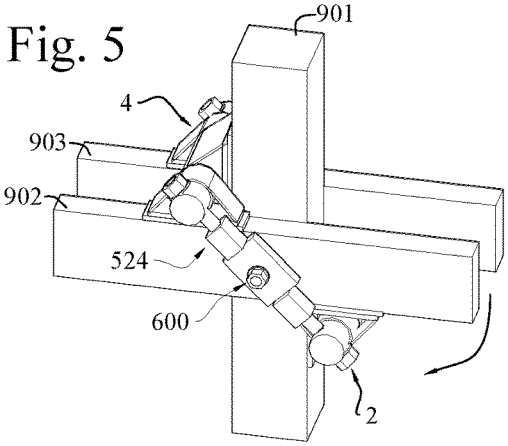
FIG. 5 shows a pinned single RBR connector joining rectangular member.
Figure 7A:
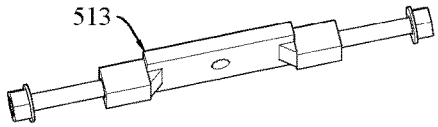
FIGS. 7A and 7B show linkage parts and assembly for a pinned RBR connector.
Figure 7B:
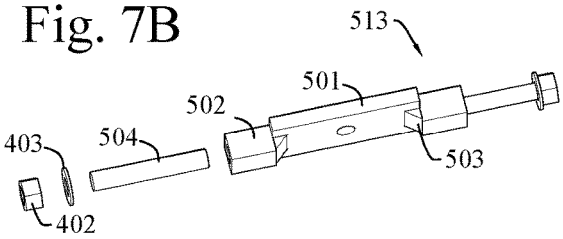
Figure 22:
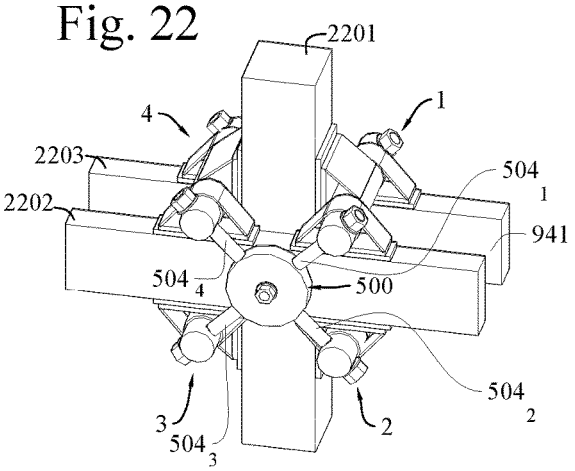
FIG. 22 shows double RBR connectors with a link spoke hub type linkage.

Referring now to FIG. 5, an exemplary illustration in which a pin assembly 600 is installed through the neutral axis of the members. In particular, such an embodiment may be used for conditions where external forces are greater than the friction holding capacity. Briefly referring to FIGS. 8A and 8B, the pin assembly 600 may include a pin 601, a pin housing 602, pin nuts 603 and pin washers 604. In an embodiment of a RBR connector that utilizes the pin assembly 600, the pinned linkages 513 and 524, as shown in FIGS. 7A and 7B, are used in place of the rod linkages $\mathbf{424}_1$ and $424_2$. Alternatively, a link spoke hub 500, as shown in FIG. 22, could be used in place of the pinned linkages 513 and 524 (e.g., when independent link length adjustments, inserts and member sizes do not change from the linkage crossing angle of the hub design).

Figure 6:
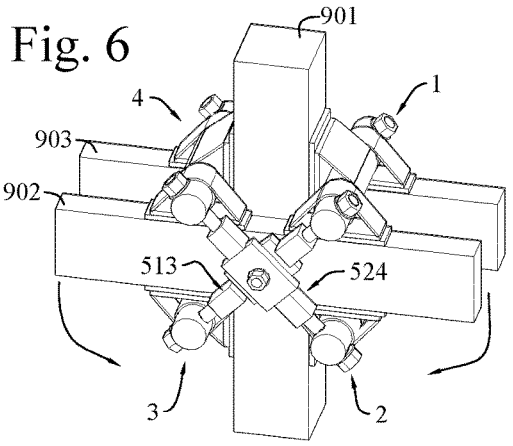
FIG. 6 shows a pinned double RBR connector joining rectangular member.

Referring to FIG. 6, a double RBR connector which restrains MM 901 and SM1 902 and SM2 903 for loads from either direction is shown. As illustrated in FIG. 6, the double RBR connector uses pressure block assemblies 1 and 3 coupled by bi-lateral pinned linkage assembly 513 and pressure block assembly 2 and 4 coupled by bi-lateral pinned linkage assembly 524 to form the connection. Although not shown, bi-lateral pinned linkage assemblies 513 and 524 are used in a similar manner with respect to the portion of the connection involving SM2 903.

Referring to FIGS. 7A and 7B, pinned linkage assembly 513 is shown. The pinned linkage assembly 513 includes a center link 501 with a hole for a pin 601. In one embodiment, spoke coupling 502 is drilled and tapped for threaded link spoke 504 and is coupled to center link 501 by transition component 503. The combined part including center link 501, spoke coupling 502 and transition component 503 may be a physical connection such as a weldment, a casting, a forging or the like. The thickness of center link 501 may be half the width of spoke coupling 502. In an alternative embodiment, the thickness of the center link 501 may be thinner than half of the width of the spoke coupling 502. Yet in another embodiment, the thickness of the center link 501 may be thicker than half of the width of the spoke coupling 502. In one embodiment, a washer is installed between center link 501 and SM1 903 and the center link 501 and SM2 903 so that all four link spokes 504 will be aligned in the same plane with an extension of their centerline intersecting at a common point. The side surface of center link 501 may be sized according to a size of the spoke coupling 502 and transition component 503 (e.g., so as to avoid interference due to a coupling of the pinned linkage assembly 513 with one or more pinned linkage assemblies).

Figure 8A:
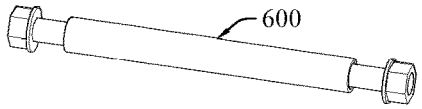
FIGS. 8A and 8B show pin parts and assembly for a pinned RBR connector.
Figure 8B:
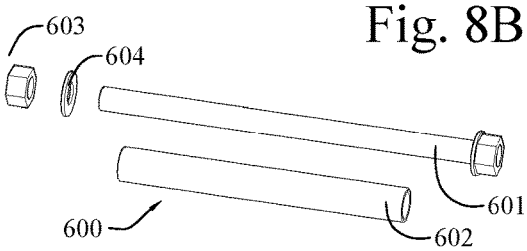

Referring now to FIGS. 8A and 8B, a pin 600 assembly is shown. The pin assembly 600 includes pin 601, pin housing 602, pin nuts 603 and pin washers 604. The pin housing 602 facilitates holding alignment while assembling. The pin housing 602 is sized and designed for the loads, material and section of MM 901 and SM1 902 and SM2 903. For example, the pin housing 602 may be installed as a fabricated weldment for W or C sections. The bending strength loss of MM 901 and SM1 902 and SM2 903 from installing pin housing 602 is relatively small because the material removed from the member in making the hole is close to the neutral axis where bending stress is zero, or substantially zero as is known in the art.

Figure 9:
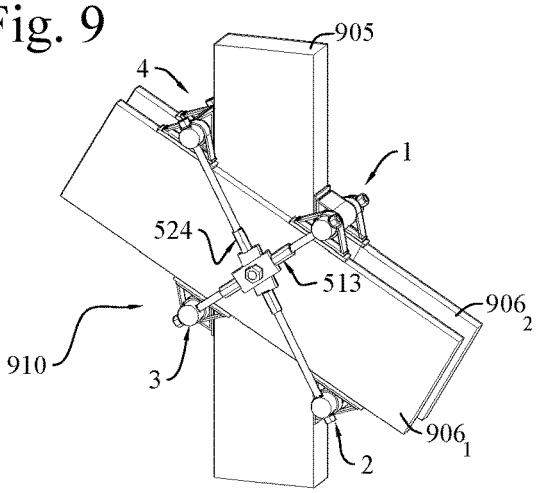
FIG. 9 shows a pinned double RBR connector joining rectangular members at a skewed angle.
Figure 10:
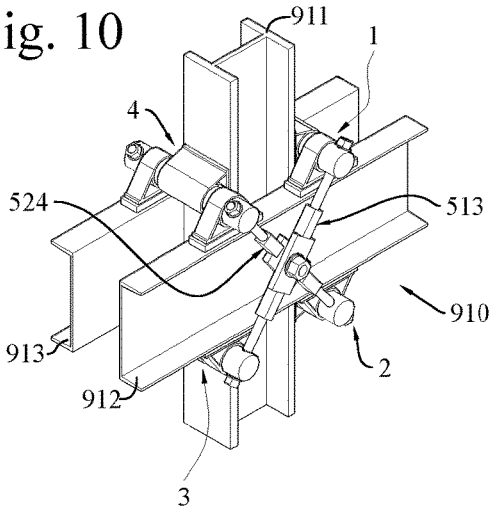
FIG. 10 shows a pinned double RBR connector joining structural steel C and W section members.
Figure 11:
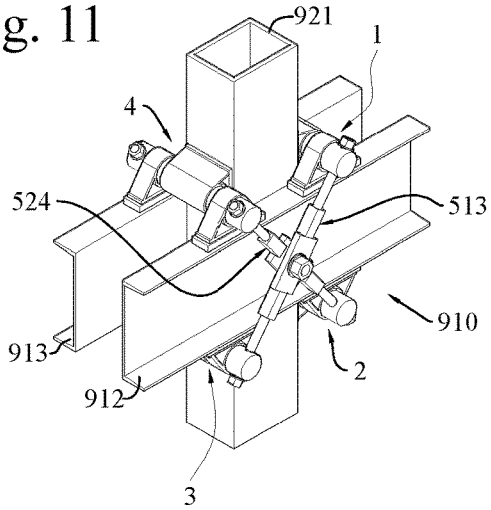
FIG. 11 shows a pinned double RBR connector joining structural steel C and tube steel section members.
Figure 12:
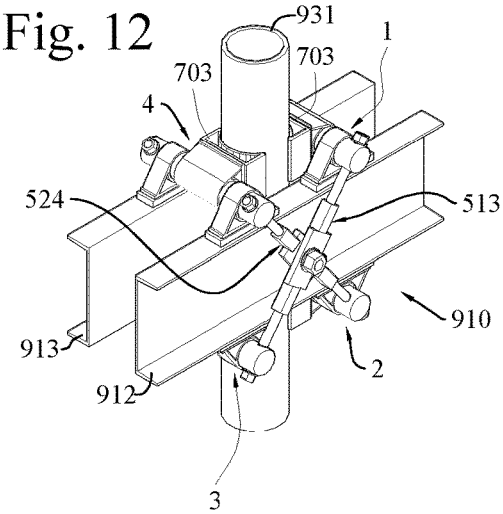
FIG. 12 shows a pinned double RBR connector joining structural steel C and round section members.

Referring to FIG. 9, an embodiment is provided illustrating the flexibility to utilize a double RBR connector for a range of different skew angles is shown. The double RBR connector 910 includes two sets of pinned linkage 513 and 524, which may be adjusted to form the connection illustrated in FIG. 9, e.g., SM1 902 and SM2 903 coupled to the MM 901 at an angle other than 90 degrees, while the components of the pressure block assemblies 1, 2, 3 and 4 remain the same. In the embodiment shown in FIG. 9, the length of the pinned linkage 513 differs from the length of the pinned linkage 524. In one embodiment, the pinned linkages 513 and 524 may have adjustable lengths Referring to FIGS. 10-12, the RBR connector 910 may be used for moment resisting rigid connections with MM and SMs of different sections as shown by: (i) the illustration of FIG. 10, which shows the joining of a MM steel W section 911 with SM steel C sections 912 and 913, (ii) the illustration of FIG. 11, which shows the joining of a MM tube steel section 921 with SM steel C sections 912 and 913, and (iii) the illustration of FIG. 12, which shows the joining of a MM steel pipe section 931 with SM steel C sections 912 and 913. Pipe pad insert 703 provides transition between the flat pressure pad 103 and round pipe surfaces of MM 931 and is also shown in FIG. 1. This is the method for making an RBR connector mate with shapes not having a flat bearing surface.

Figure 13:
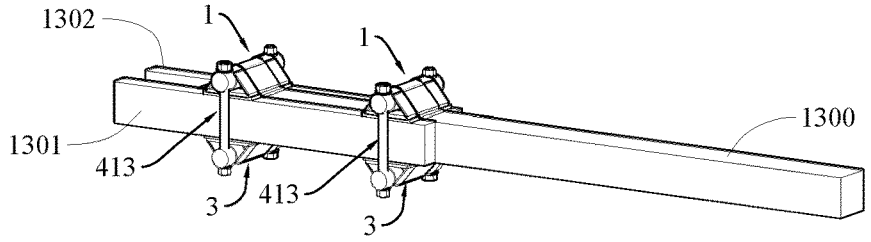
FIG. 13 shows two single RBR connectors spaced longitudinally at an overlapping three member joint consisting of rectangular members to form a rigid straight splice between the members.

Referring to FIG. 13, a moment resisting rigid splice using two longitudinally spaced RBR connectors to join rectangular SM1 902 and SM2 903 with rectangular MM 1300 is shown. Such an embodiment is useful for installations that include an adjustable length member.

Figure 14:
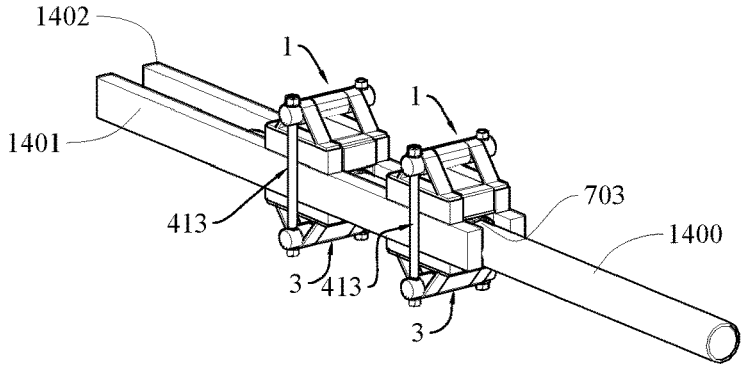
FIG. 14 shows the same connectors as FIG. 13 with the side members rectangular shaped and the main member as a pipe section to form a rigid straight splice connection.

Referring to FIG. 14, a moment resisting rigid splice using two longitudinally spaced RBR connector to join rectangular SM1 902 and SM2 903 with pipe section MM 1400 is shown. Such an embodiment is useful for installations that include a transition from rectangle to pipe or an adjustable length member.

Figure 15:
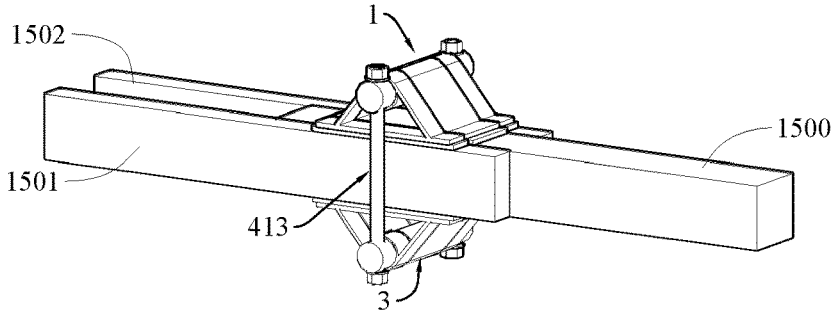
FIG. 15 shows a single RBR connector in straight tightly clamped three member connection.

Referring to FIG. 15, a two direction limiting motion moment resisting rigid splice using one RBR connector to join rectangular SM 1502 and SM 1501 with rectangular MM 1500 is shown. Such an embodiment is useful for installations that include a flexible connection with hard rigid stops as well. The limit of angular rotation is controlled by the adjusted length of threaded rod linkage 413.

Figure 16:
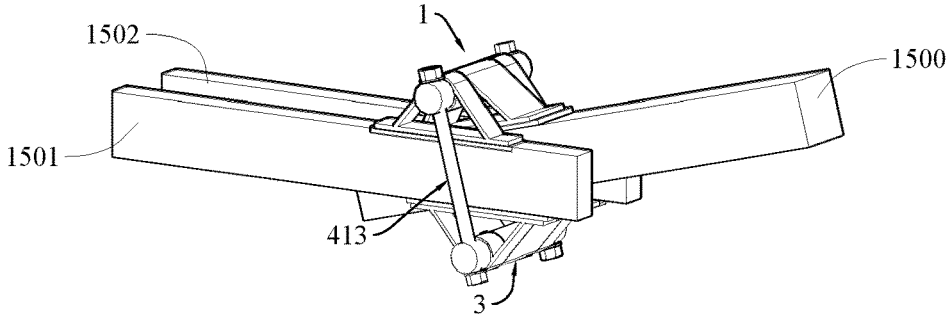
FIG. 16 shows a single RBR connector in skewed angle tightly clamped three member connection.

Referring to FIG. 16, the connection is shown to illustrate limiting motion. The length of threaded rod linkage 413 may be adjusted for MM 1500 to be positioned at an angle with respect to SM 1502 and SM 903.

Figure 17:
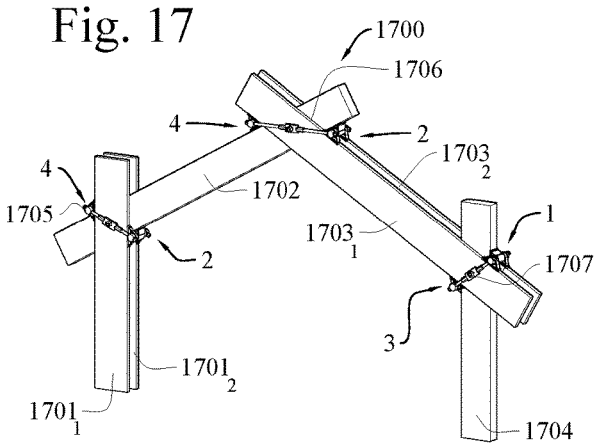
FIG. 17 shows three single RBR connectors joined together to form a gable roof building frame also referred to as portal building frame.

Three RBR connectors are used to construct a frame such as a gable roof rigid building frame, also known as a portal building frame, are shown in FIG. 17. Specifically, a single RBR connector 1700 is used to connect two first columns $\mathbf{1701}_1$-$\mathbf{1701}_2$ to a first gable 1702, the first gable 1702 to two second gables $\mathbf{1703}_1$-$\mathbf{1703}_2$ at a ridge, and the two second gables $\mathbf{1703}_1$-$\mathbf{1703}_2$ to a second column 1704. A double RBR connector, not shown, can be used to provide additional lateral support in the embodiment shown in FIG. 17, or for any single RBR connector shown herein. With portal building frame rigid moment design, the structural member strength is used more efficiently by restraining the structural members at each connection, which allows either greater spans or frame spacing for the same size structural members compared to unrestrained framing.

Figure 18:
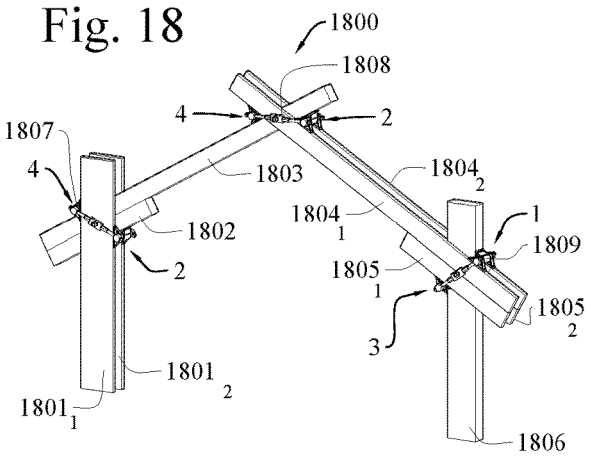
FIG. 18 shows three single RBR connectors joined together to form a portal building frame with reinforced haunches at the column to beam joint.

Referring to FIG. 18, an illustration of three RBR connectors used to construct the portal frame 1800 is shown. Such an embodiment uses a first RBR connector 1807 to connect two first columns $\mathbf{1801}_1$-$\mathbf{1801}i$ to a first gable 1803 and a first support 1802, a second RBR connector 1808 to connect the first gable 1803 to two second gables $\mathbf{1804}_1$-$\mathbf{1804}_2$ at a ridge, and a third RBR connector 1809 to connect the two second gables $\mathbf{1804}_1$-$\mathbf{1804}_2$ and two second supports $\mathbf{1805}_1$-$\mathbf{1805}_2$ to a second column 1806. The haunch at the roof beam-to-column connection is made deeper to withstand the frame's largest moments that occur in this location. Making the haunch deeper can be done by doubling the beam's depth with the same section of material and adjusting the threaded rod linkages of the second RBR connector 1808 to accommodate the deeper section. Alternatively, a steel strap may be inserted and fastened to one or more structural members to form a composite instead of utilizing an insert between a pressure block and a structural member (e.g., as illustrated by component 702 in FIG. 4).

Figure 19:
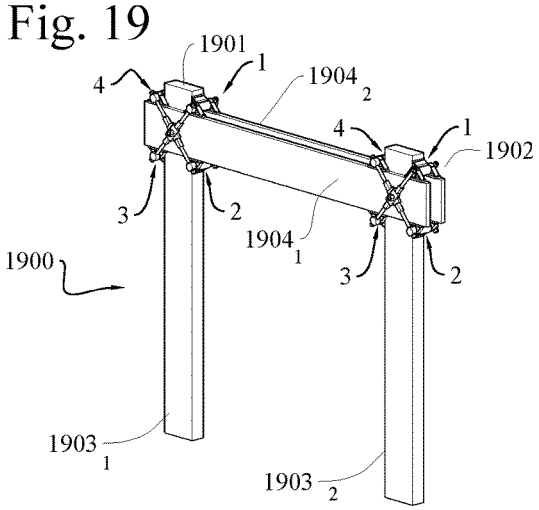
FIG. 19 shows two double RBR connectors joined together to form a moment resisting rigid frame with side members (SM) as header and main member (MM) as columns.
Figure 20:
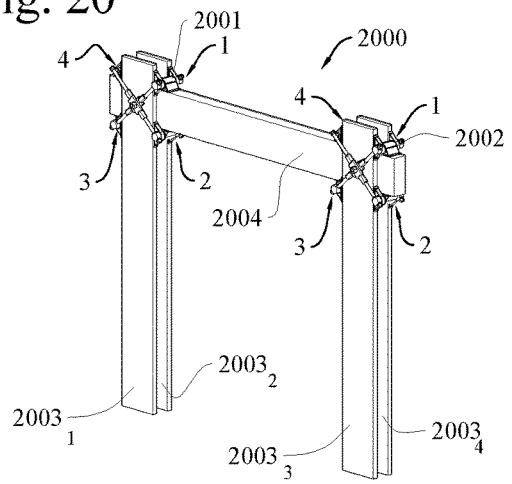
FIG. 20 shows two double RBR connectors joined together to form a moment resisting rigid frame with MM as header and SM as columns.

Two moment resisting rigid frames are shown in FIG. 19 and FIG. 20. Referring to FIG. 19, two double RBR connectors, RBR connector 1901 and RBR connector 1902, are used to form a moment resisting rigid frame 1900. Specifically, MM $\mathbf{1903}_1$-$\mathbf{1903}_2$ are used as columns and SM $\mathbf{1904}_1$-$\mathbf{1904}_2$ are cross beams coupled to the columns via RBR connector 1901 and RBR connector 1902. Referring to FIG. 20, two double RBR connectors, RBR connector 2001 and RBR connector 2002 are used to form a moment resisting rigid frame 2000. Specifically, SM $\mathbf{2003}_1$-$\mathbf{2003}_2$ are used as columns coupled to cross beam MM 2004 by the double RBR connector 2001 and SM $\mathbf{2003}_3$-$\mathbf{2003}_4$ are also used as columns coupled to the cross beam MM 2004 by the double RBR connector 2002.

Figure 21:
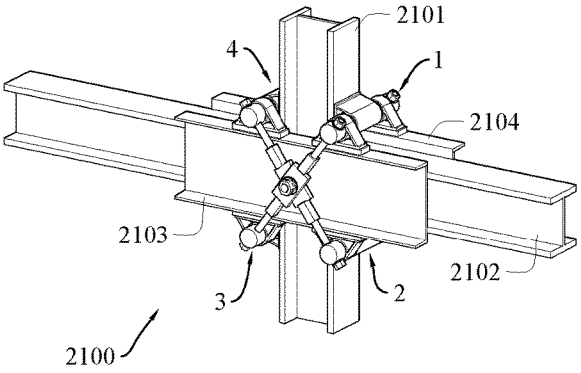
FIG. 21 shows a double RBR connector with structural steel C sections for support of column and beam configuration.

Referring to FIG. 21, an example by which an RBR connector may be configured over a new or existing structure is shown. For example, the coupling of column 2101 and beam 2012 may be an existing structure (e.g., may be lacking in support). In such an embodiment, the double RBR connector 2100 may be configured over the existing coupling along with the insertion of beams 2103 and 2014 to add support to the coupling. Beams 2103 and 2104 may be attached or locked into member beam 2102 as needed based on a case-by-case basis.

Referring to FIG. 22, an exemplary illustration of a link spoke hub 500 is shown. For example, the link spoke hub 500 may be configured to for use when independent link length adjustments, inserts and member sizes do not change from the linkage crossing angle of the hub design. In an alternative embodiment, a pin independent of any linkage may be installed that passes through the column 2201 and the beams 2202 and 2203.

Figure 23:
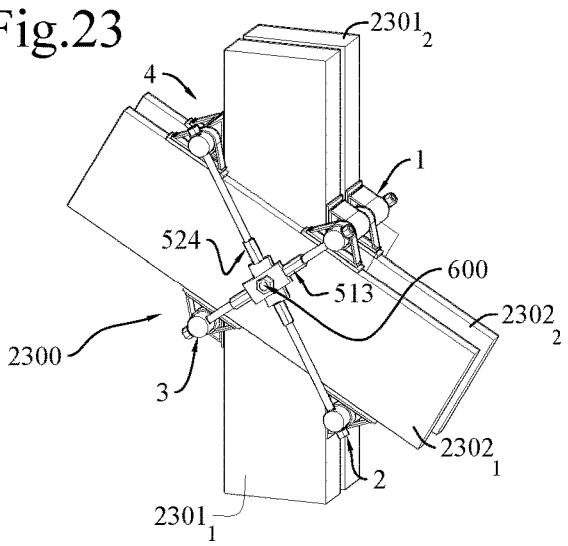
FIG. 23 shows double RBR connectors joining four structural members.

Referring to FIG. 23, an example by which a double RBR connector is used to form a four member connection is shown. Specifically, double RBR connector 2300 includes the block and shaft assemblies 1, 2, 3 and 4, the pinned linkages 513 and 524, and the pin assembly 600. The double RBR connector 2300 is shown as coupling SM $\mathbf{2302}_1$-$\mathbf{2302}_2$ to MM $\mathbf{2301}_1$-$\mathbf{2301}_2$ at a first skew angle.

Figure 24:
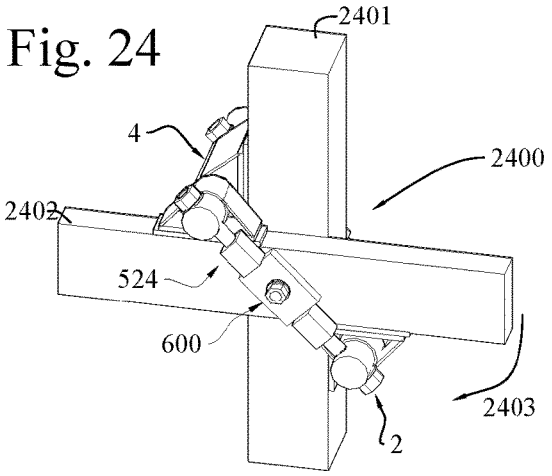
FIG. 24 shows a single RBR connector joining two structural members.

Referring to FIG. 24, an example by which a RBR connector is used to form a two member connection is shown. Specifically, RBR connector 2400 includes the block and shaft assemblies 2 and 4, the pinned linkage 524, and the pin assembly 600. The RBR connector 2400 is shown as coupling MM 2401 to SM 2402 such that member forces are restrained in the direction indicated by arrow 2403.

Figures 25, 26:
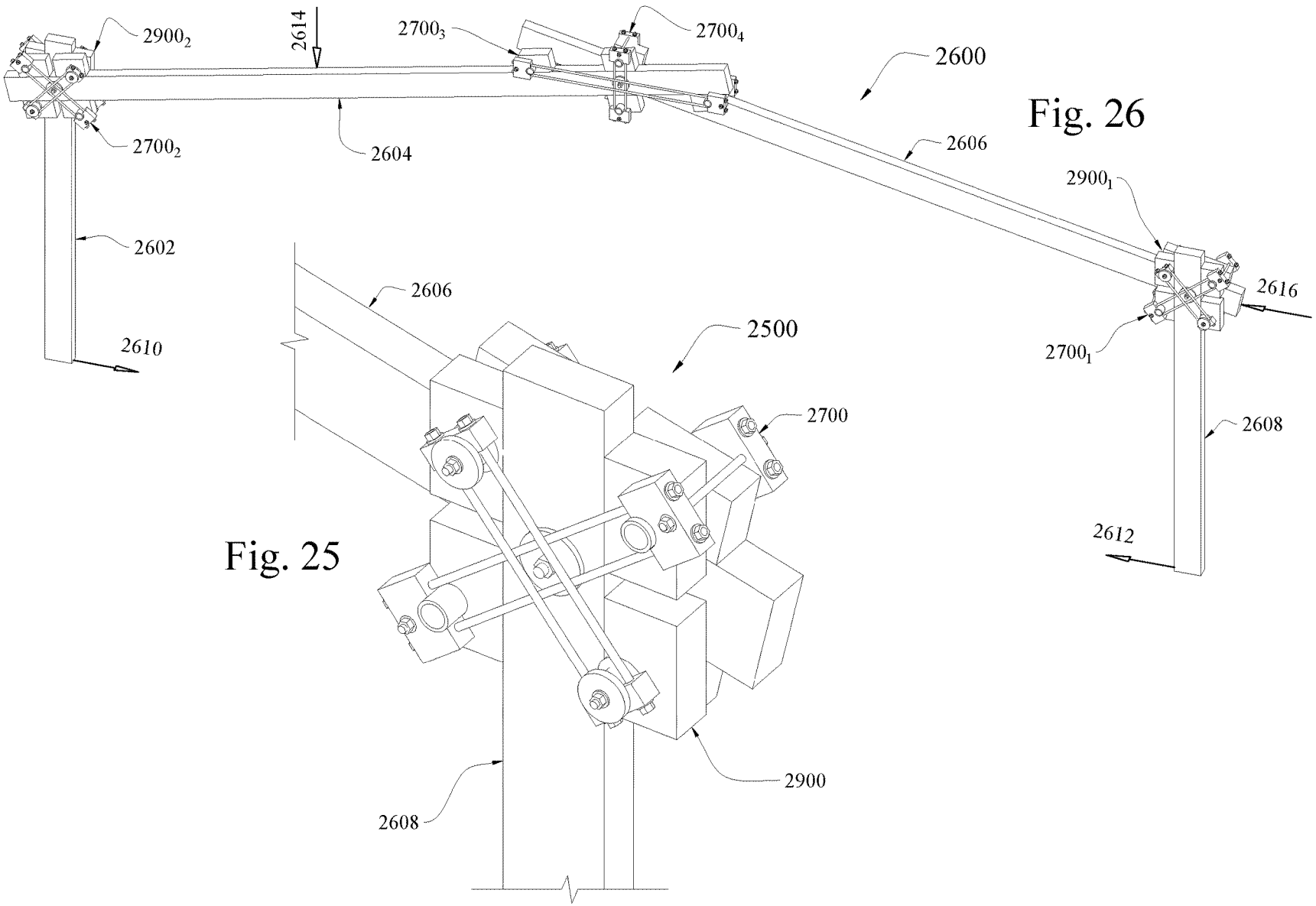
FIG. 25 shows a first embodiment of a double RBR connector according to one embodiment.
FIG. 26 shows an illustrative portal frame with three double RBR connectors configured to resist both vertical roof and lateral loads parallel to the portal frame in two directions of rotation according to one embodiment.

II. Improved Rolling Block Restraint Connector For External Restraint Moment Connections Referring now to FIG. 25, a first embodiment of a double RBR connector 2500 is shown according to one embodiment. FIG. 25 depicts the RBR connector 2500 having two-rod-linkage components which is alternative in lieu of the single-linkage rod shown in, for example, FIGS. 1A-2. In some embodiments, the double RBR connector 2500 does not include apertures in the block shafts such as the block shaft 2830 of FIG. 28 and the block shaft 3030 of FIG. 30. A saddle, such as the saddle 2842 of FIG. 28 and the saddle 3040 of FIG. 30, with channels for rods is fit over each opposing block shaft and linked to each other by installing two threaded rods through the saddle channels and fixed by threaded fasteners. The channels on one saddle may be threaded to facilitate installation and adjustment of the connector.

This two-rod linkage component provides advantageous benefits including, but not limited to, (i) the ability to install a long block shaft that extends and interconnects to adjacent aligned RBR connectors, (ii) the ability to install an unobstructed pin through the centerline intersection of the structural members which would otherwise be obstructed when utilizing single-rod linkage, (iii) the simplification of block shaft fabrication by eliminating the requirement of forming a transverse aperture through the block shafts for passage of single linkage rods, wherein the block shaft includes a longitudinally-hollow, tubular shaped component, (iv) the ability to maintain shaft strength by eliminating need to make an aperture in the shaft, (v) the ability for changes to be made to members, blocks, and linkages on shafts, (vi) the allowance of the use of smaller diameter rods with two linkage rods at each location rather than just a single rod, (vii) the provision of a flat bearing surface for rod fastener compared to a round surface, which occurs when using a single shaft with aperture in the shaft, and (viii) the allowance of a threaded rod to be installed through the block shaft forming a transverse clamp.

Figure 28:
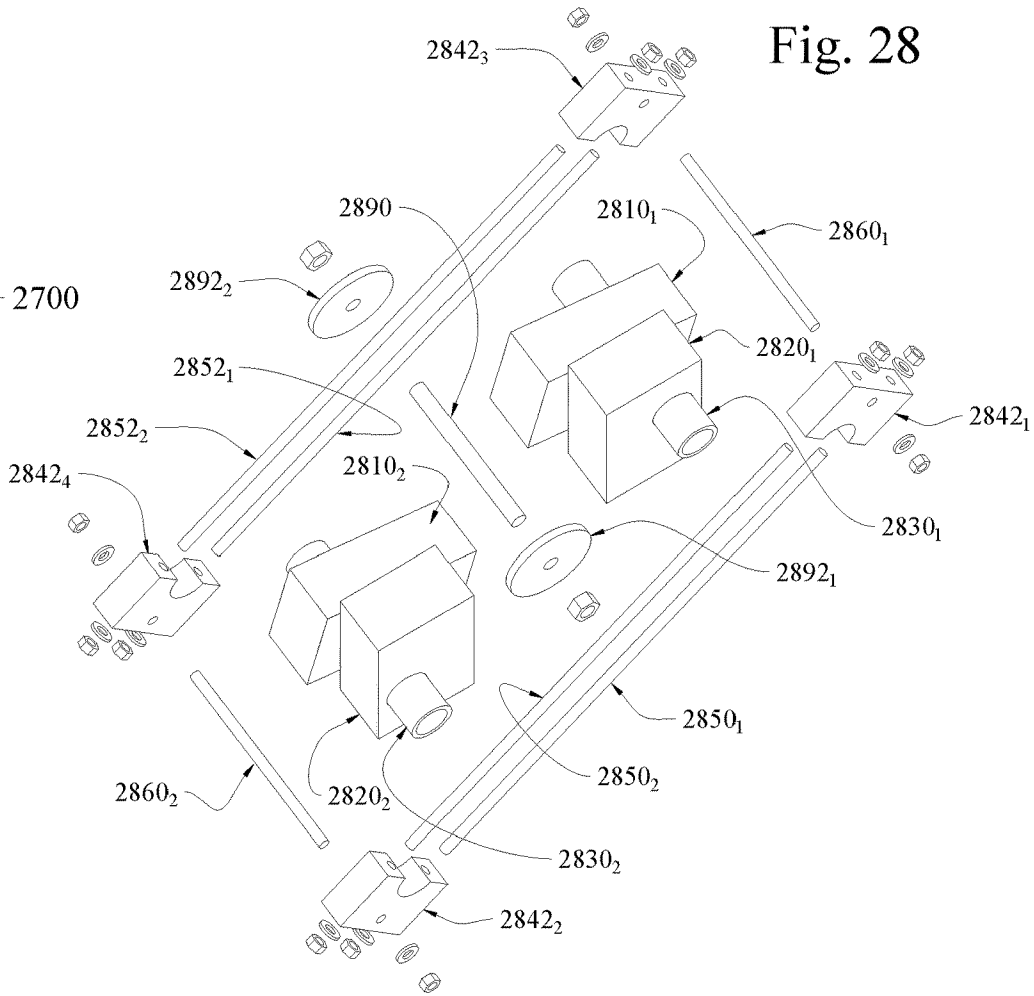
FIG. 28 shows an exploded view of the single RBR connector of FIG. 27 according to one embodiment.
Figure 30:
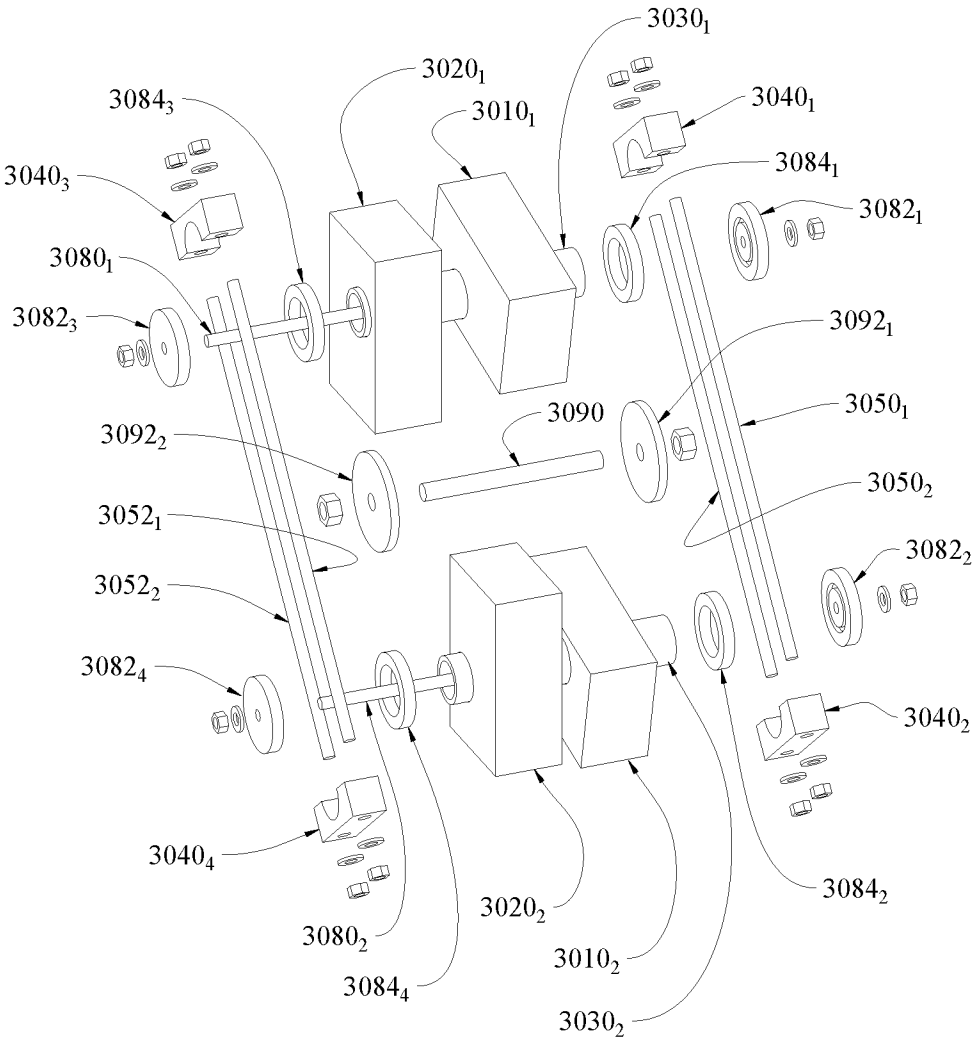
FIG. 30 shows an exploded view of the single RBR connector of FIG. 29 according to one embodiment.

The transverse clamp, such as the transverse clamp 2860 of FIG. 28 and the transverse clamp 3080 of FIG. 30, provides further advantageous benefits, including but not limited or restricted to, (1) maintaining alignment of the connection after assembly, (2) keeping parts together during the assembly process, and (3) keeping parts tight together to increase member strength at the connection.

Referring to FIG. 26, an illustrative portal frame with three double RBR connectors configured to resist both vertical roof and lateral loads parallel to the portal frame in two directions of rotation is shown according to one embodiment. FIG. 26 shows a portal frame consisting of columns 2602 and 2608, and beams 2604 and 2606. The respective primary connectors are $\mathbf{2700}_1$, $\mathbf{2700}_2$, and $\mathbf{2700}_3$. The respective secondary connectors are $\mathbf{2900}_1$, $\mathbf{2900}_2$ and $\mathbf{2700}_4$. The vertical load represented by 2614 will produce forces reacted by primary connectors $\mathbf{2700}_1$, $\mathbf{2700}_2$ and $\mathbf{2700}_3$. As the lateral load 2616 increases the reaction for $\mathbf{2700}_2$ increases and eventually produce forces reacted by the secondary connectors $\mathbf{2900}_1$ and $\mathbf{2700}_4$.

Figure 27:
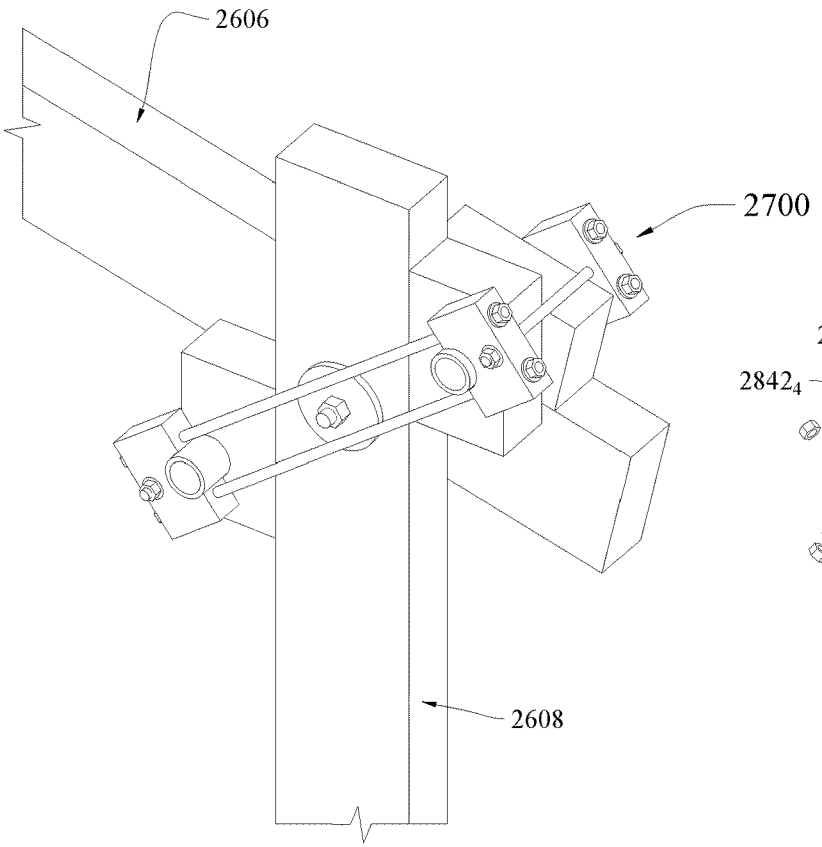
FIG. 27 shows a first embodiment of a single RBR connector according to one embodiment.

Referring to FIG. 27, a first embodiment of a single RBR connector is shown according to one embodiment. FIG. 27 shows a 2-member, single RBR connector 2700 with multi-rod linkage (e.g., a two-rod linkage) which serves as the primary RBR connector 2700 of FIG. 25 and also located at $\mathbf{2700}_1$, $\mathbf{2700}_2$, $\mathbf{2700}_3$ and secondary RBR connector $\mathbf{2700}_4$ for the frame structure shown in FIG. 26. This RBR connector also includes a transverse clamp. In one embodiment, the single RBR connector creates a connection between two members with two-rod linkage, a pin at crossing center, and rods installed through the linkage saddles, wherein the rods form a portion of the transverse clamp.

Referring to FIG. 28, an exploded view of the single RBR connector of FIG. 27 is shown according to one embodiment. Column member 2608 and beam member 2606 are coupled together by the threaded pin 2890, washers $\mathbf{2892}_1$-$\mathbf{2892}_2$ and nuts. Block shafts $\mathbf{2830}_1$-$\mathbf{2830}_2$ are inserted through channels of the beam blocks $\mathbf{2810}_1$-$\mathbf{2810}_2$ and the column blocks $\mathbf{2820}_1$-$\mathbf{2820}_2$ and positioned at opposite diagonal vertices of the joint. A double rod linkage is formed by two threaded rods $\mathbf{2850}_1$-$\mathbf{2850}_2$ with ends inserted through channels in saddles $\mathbf{2842}_1$-$\mathbf{2842}_2$ and fit over one end of the shafts $\mathbf{2830}_1$-$\mathbf{2830}_2$. Bi-lateral linkage is formed for the opposite side of the shaft end by the saddles $\mathbf{2842}_3$-$\mathbf{2842}_4$ with two rods $\mathbf{2852}_1$-$\mathbf{2852}_2$. The rod linkages are restrained from lateral movement by transverse clamps, which are formed by transverse threaded rods $\mathbf{2860}_1$-$\mathbf{2860}_2$ coupled with fasteners inserted through channels in linkage saddles $\mathbf{2842}_1$-$\mathbf{2842}_4$.

Figure 29:
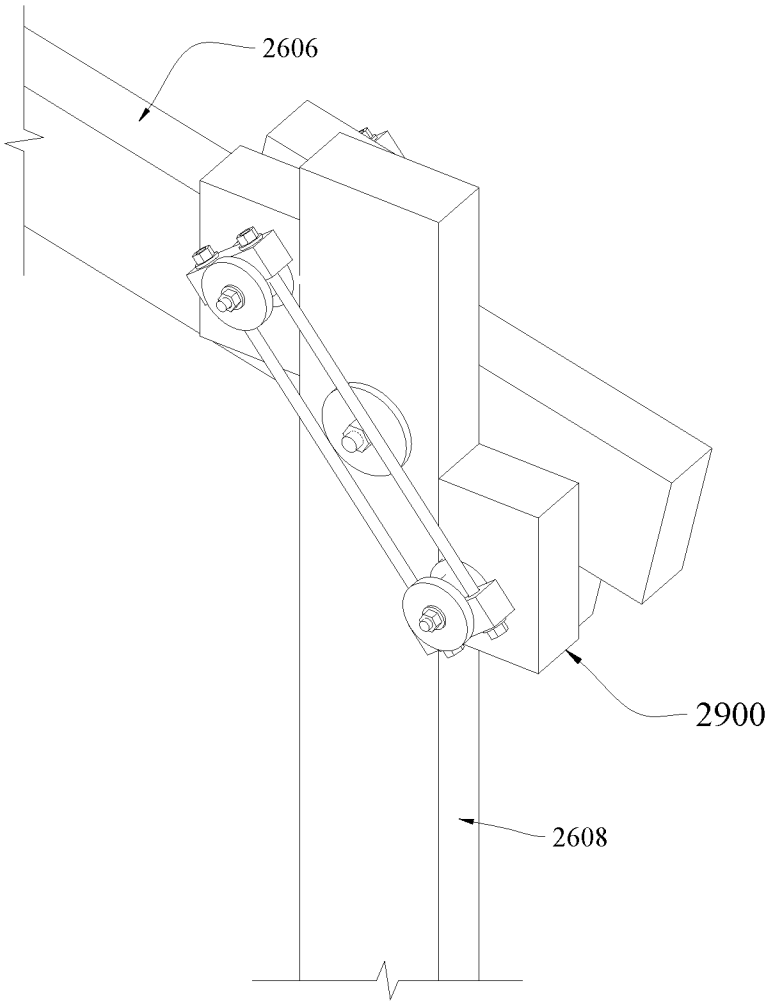
FIG. 29 shows a second embodiment of a single RBR connector according to one embodiment.

Referring to FIG. 29, a second embodiment of a single RBR connector is shown according to one embodiment. FIG. 29 shows a two-member, single RBR connector 2900 with two-rod linkage which serves as the secondary RBR connector 2900 shown in FIG. 25 located at each joint of the frame structure shown by $\mathbf{2900_1}$-$\mathbf{2900_2}$ in FIG. 26. This RBR connector also includes a transverse clamp. The RBR connector 2900 may be installed and configured to resist secondary lateral and upward vertical loadings that occur periodically for a portal frame structure that includes a transverse clamp.

Referring to FIG. 30, an exploded view of the single RBR connector of FIG. 29 is shown according to one embodiment. Holes are made in column member 2608 and beam member 2606 and pinned together with the threaded shaft "pin" 3090, washers $\mathbf{3092_1}$-$\mathbf{3092_2}$ and nuts. Block shafts $\mathbf{3030_1}$-$\mathbf{3030_2}$ are inserted through channels of respective beam blocks $\mathbf{3010_1}$, $\mathbf{3010_2}$ and column blocks $\mathbf{3020_1}$-$\mathbf{3020_2}$ are positioned at opposite diagonal vertices of the joint. A two-rod linkage is formed by two saddles $\mathbf{3040_1}$-$\mathbf{3040_2}$, two threaded rods $\mathbf{3050_1}$-$\mathbf{3050_2}$ with fasteners and the length adjusted for the column to beam angle. A second two-rod linkage is formed for the opposite side of the shaft end by the saddles $\mathbf{3040_3}$-$\mathbf{3040_4}$ with two rods $\mathbf{3052_1}$-$\mathbf{3052_2}$. The four shaft spacer washers $\mathbf{3084_1}$-$\mathbf{3084_4}$ provide clearance for primary linkages installed inboard of the secondary linkages shown in FIG. 28. The rod linkages, blocks and members are restrained from lateral movement by transverse clamps formed by transverse threaded rods $\mathbf{3080_1}$-$\mathbf{3080_2}$ coupled with fasteners inserted through channels in block shafts $\mathbf{3030_1}$-$\mathbf{3030_2}$. The endcaps $\mathbf{3082_1}$-$\mathbf{3082_4}$ are machined to center on the installed block shaft.

Figure 31:
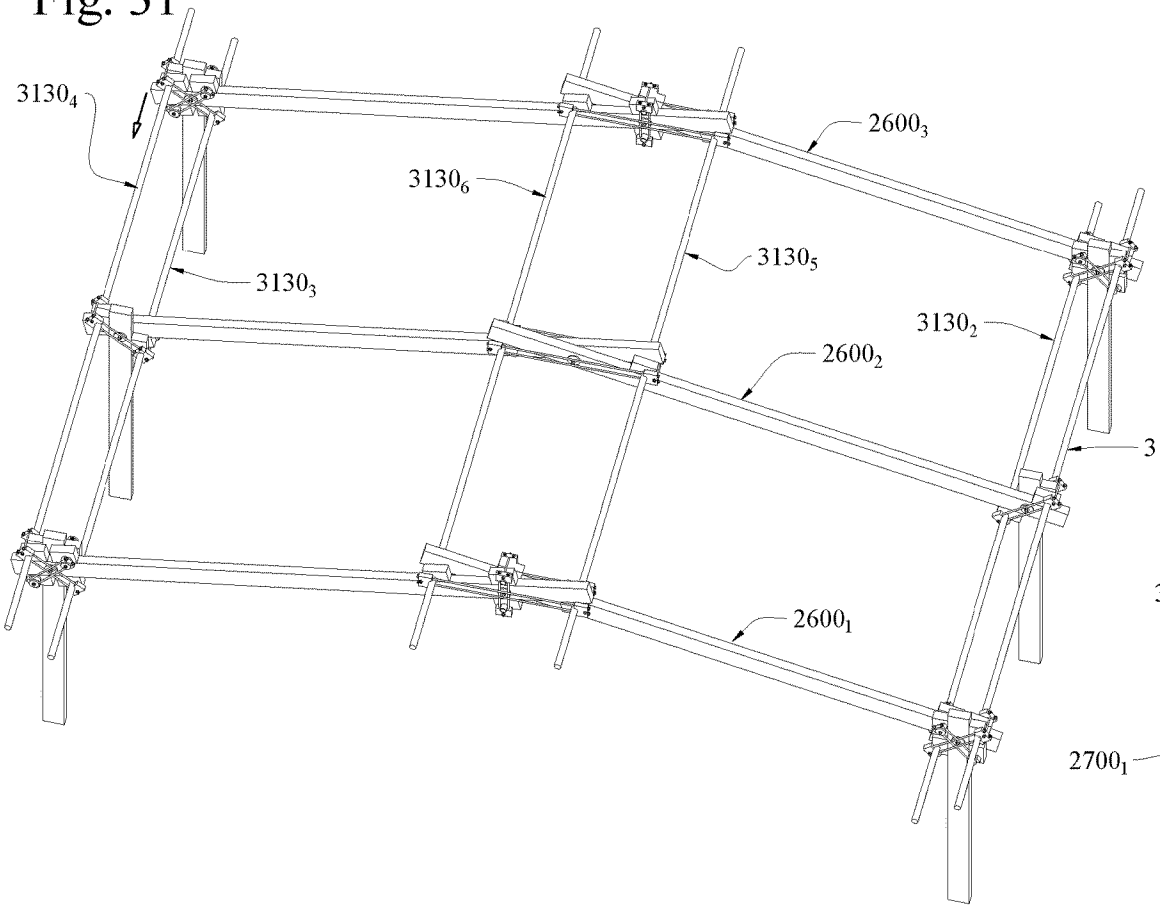
FIG. 31 shows three portal frames installed in parallel and connected together using shafts extending between each frame according to one embodiment.

Referring now to FIG. 31, three portal frames installed in parallel and connected together using shafts extending between each frame are shown according to one embodiment. FIG. 31 shows three portal frames $\mathbf{2600_1}$-$\mathbf{2600_3}$ configured in parallel with each other forming a three-dimensional structure with frame interconnected by six shafts $\mathbf{3130_1}$-$\mathbf{3130_6}$ of the primary RBR connectors. The RBR connector provides clamping force to these long shafts on both sides of the column members to fix the frame spacing and make a moment connection in the direction perpendicular to the frames.

Figure 32:
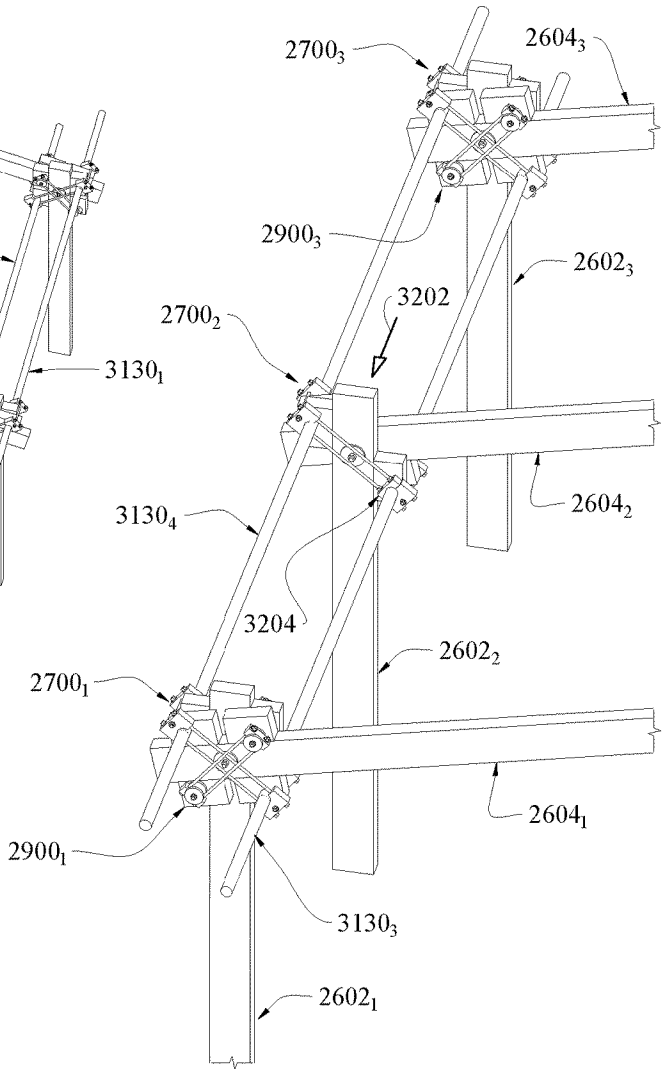
FIG. 32 shows a detailed perspective of a first side of the three portal frames shown in FIG. 31 according to one embodiment.

Referring to FIG. 32, a detailed perspective of a first side of the three portal frames shown in FIG. 31 is shown according to one embodiment. FIG. 32 shows a portion of FIG. 31 with 2 long block shafts. A lateral load applied perpendicular to the frames such as 3202 make tension and compression forces develop between shafts which can be restrained at the linkage saddles by adding clamps in this location to function structurally as top and bottom chords of a truss as shown by the added saddle shown as 3204. The space between the shafts $\mathbf{3130_3}$-$\mathbf{3130_4}$ can have structure added if more strength is needed than that of the pipes alone.

Figure 33:
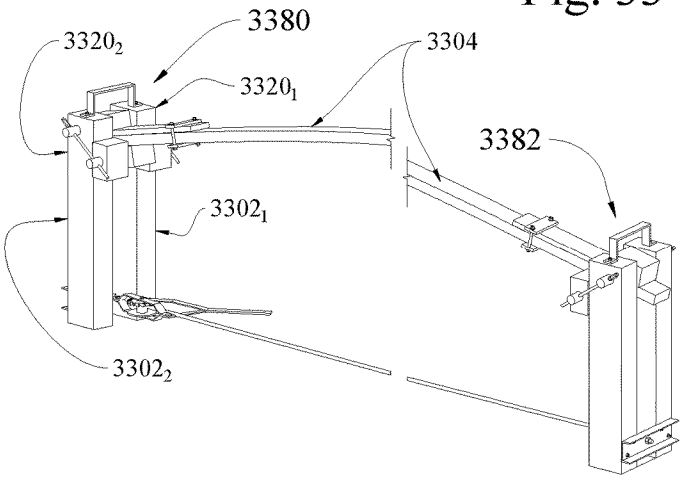
Referring to FIG. 33, beam-end support apparatuses having portable free-standing columns and a RBR connector are shown according to one embodiment.

Referring to FIG. 33, beam-end support apparatuses having portable free-standing columns and a RBR connector are shown according to one embodiment. The beam-end support apparatuses 3380-3382 each include connector that provides a fixed-end condition at joints that, when compared to a simple supported beam, have ⅕ the midspan deflection and ⅓ the midspan stress for a uniform load. This allows for larger spans using the same size members. As is known in the art, the term "midspan" refers to the point on a member (e.g., a beam or a column) that is equidistant from the two end supports. Deflection curves in FIGS. 35 and 36 show examples for these two different support types. The upper RBR connector shaft is installed through a channel formed in the columns $\mathbf{3302_1}$-$\mathbf{3302_2}$ to function as column blocks $\mathbf{3320_1}$-$\mathbf{3320_2}$ and spread for the beam width and fit with a rolling block $\mathbf{3410_1}$ of FIG. 34 to press onto the upper surface of the beam. In one embodiment, a beam 3304 is inserted between upper-member beam block $\mathbf{3410_1}$ and lower-member beam block $\mathbf{3410_2}$. Subsequently, the linkages $\mathbf{3450_1}$-$\mathbf{3450_2}$ and a tensioning system 3471, discussed below, are adjusted, causing the beam 3304 to form the unloaded beam shape as in FIGS. 36A-36B.

Figure 34A:
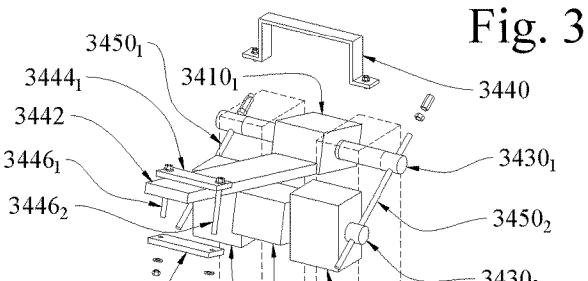
FIG. 34 shows an exploded view of a first RBR connector of FIG. 33 according to one embodiment.
Figure 34B:
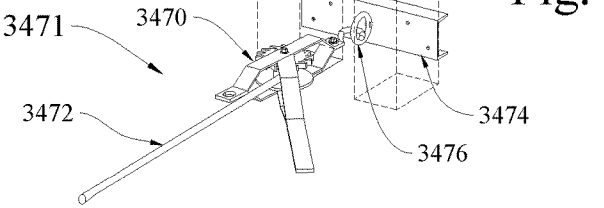

Referring to FIG. 34, an exploded view of a first RBR connector of FIG. 33 is shown according to one embodiment. In the illustration shown in FIG. 34, members $\mathbf{3302_1}$, $\mathbf{3302_2}$ and 3304 are excluded for clarity. The beam 3304 has a stop 3442 held to its top surface by plates $\mathbf{3444_1}$-$\mathbf{3444_2}$ and clamping fasteners $\mathbf{3446_1}$-$\mathbf{3446_2}$. Single-rod linkages $\mathbf{3450_1}$-$\mathbf{3450_2}$ are adjusted to fit the depth of the beam 3304. Lower shaft $\mathbf{3430_2}$ is threaded and the rod linkages are fitted with a coupling nut locked in place by a stop nut to simplify adjustment. Part 3440 is a handle for transporting and positioning. Channel section 3474 is attached to columns $\mathbf{3302_1}$-$\mathbf{3302_2}$ to fix the column spacing and transfer tension loads make via pull ring 3476 to the columns. A tensioning system is shown and comprised of a tensioning device 3470, a cable 3472, hooks to attach to pull rings 3476 and the channel section 3474.

Figure 35A:
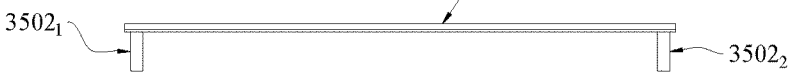
FIG. 35A shows a simple supported beam in an unloaded state according to one embodiment.
Figure 35B:
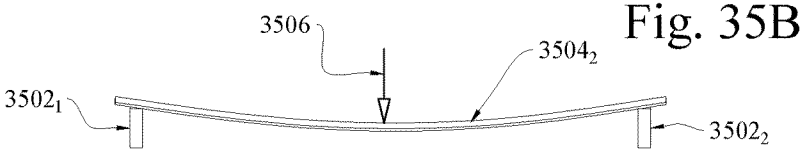
FIG. 35B shows a deflection curve for a simple supported beam in a midspan loaded state according to one embodiment.
Figure 36A:
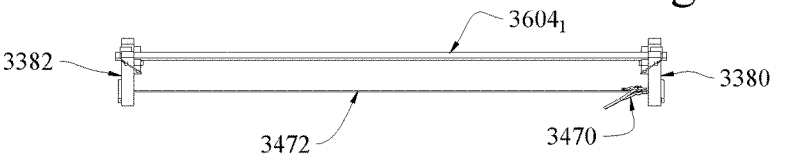
FIG. 36A shows a beam restrained with the fixed-end beam apparatus of FIG. 33 in an unloaded state according to one embodiment.
Figure 36B:
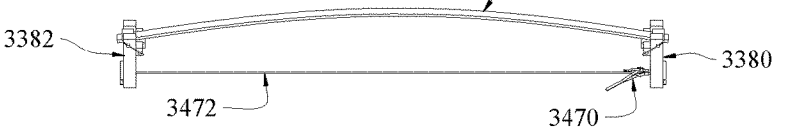
FIG. 36B shows a beam restrained with the fixed-end beam apparatus of FIG. 33 in an unloaded and arched state according to one embodiment.

Referring to FIGS. 35A-35B, the diagrams illustrate a simple supported beam in an unloaded state and a deflection curve for a simple supported beam in a midspan loaded state, respectively. Specifically, FIG. 35A illustrates a supported beam $\mathbf{3504_1}$ spanning two columns $\mathbf{3502_1}$-$\mathbf{3502_2}$. In this illustration, the beam $\mathbf{3504_1}$ is straight, e.g., no deflection, as there is no load applied to the $\mathbf{3504_1}$. In contrast, FIG. 35B illustrates a supported beam $\mathbf{3504_2}$ having a deflected shape caused by application of the load 3506.

Figure 36C:
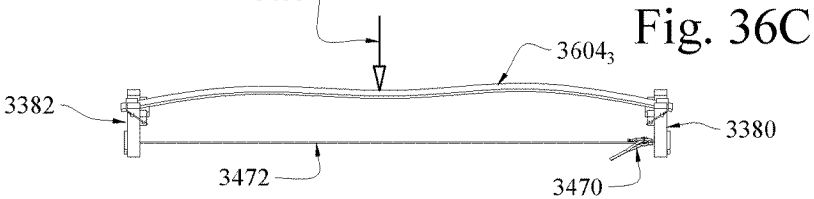
FIG. 36C shows a deflection curve for a beam restrained with the fixed-end beam apparatus of FIG. 33 in an unloaded and arched state having a midspan load according to one embodiment.

Referring now to FIGS. 36A-36C, a beam supported by columns 3380 and 3382 and coupled to the fixed-end beam apparatus of FIG. 33 is shown according to one embodiment. Specifically, FIG. 36A illustrates a supported beam $\mathbf{3604_1}$ spanning two columns 3380-3382, wherein both a fixed-end beam apparatus and a tensioning system are coupled to the beam $\mathbf{3604_1}$ and columns 3380-3382. FIG. 36A illustrates an instance in which there is no load applied to the beam $\mathbf{3504_1}$ and no tension is applied via the tensioning system.

Referring to FIG. 36B, a supported beam $\mathbf{3604_2}$ spanning the columns 3380-3382, wherein both a fixed-end beam apparatus and a tensioning system are coupled to the beam $\mathbf{3604_2}$ and columns 3380-3382 is shown according to one embodiment. Specifically, FIG. 36B illustrates an instance in which there is no load applied to the beam $\mathbf{3604_2}$ with tension applied via the tensioning system. The application of the tension results in the beam $\mathbf{3604_2}$ taking an arched shape.

Finally, referring to FIG. 36C, a supported beam $\mathbf{3604_3}$ spanning the columns 3380-3382, wherein both a fixed-end beam apparatus and a tensioning system are coupled to the beam $\mathbf{3604_3}$ and columns 3380-3382 is shown according to one embodiment. Specifically, FIG. 36C illustrates an instance in which a load is applied to the beam $\mathbf{3604_3}$ with tension applied via the tensioning system. Beam $\mathbf{3604_3}$ is illustrated as having an arched shape similar to that shown in FIG. 36B and a deflection at the midspan caused by a vertical load 3406. The deflection caused by load 3406 will be ⅕ that of the deflection by load 3506 in FIG. 35 for the same load and span, which is significant for design applications because most often, the member size is selected to meet allowable maximum deflection criteria.

Figure 38:
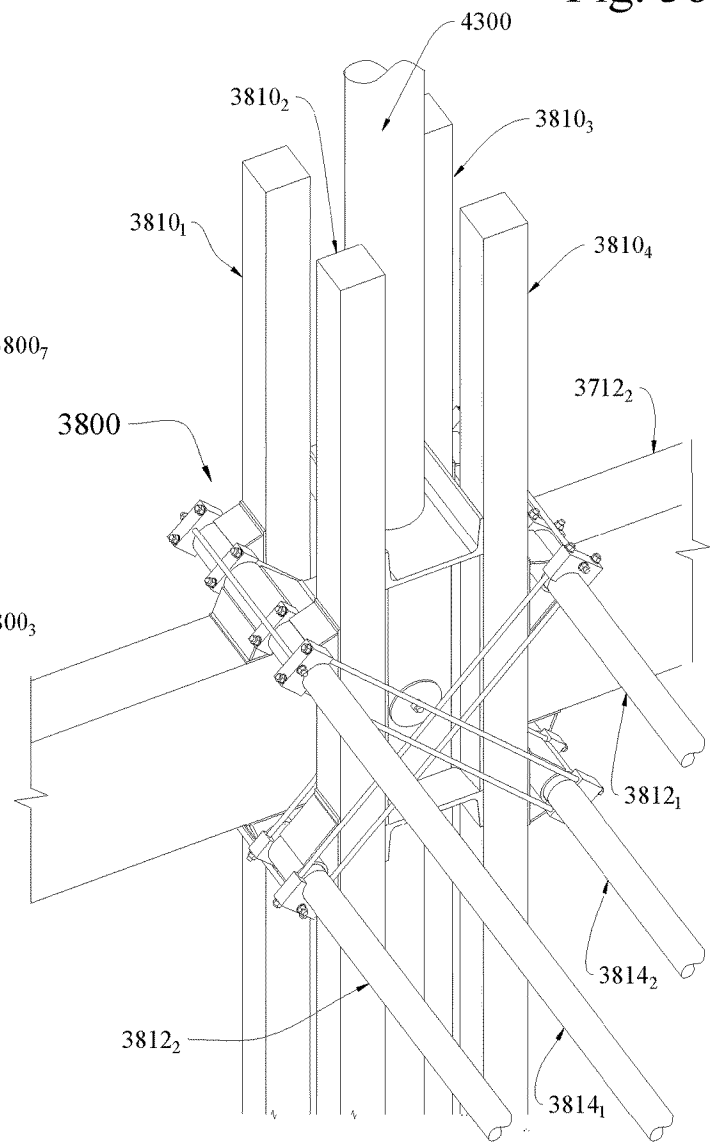
FIG. 38 shows a first corner joint connection of the structure illustrated in FIG. 37 according to one embodiment.
Figure 37:
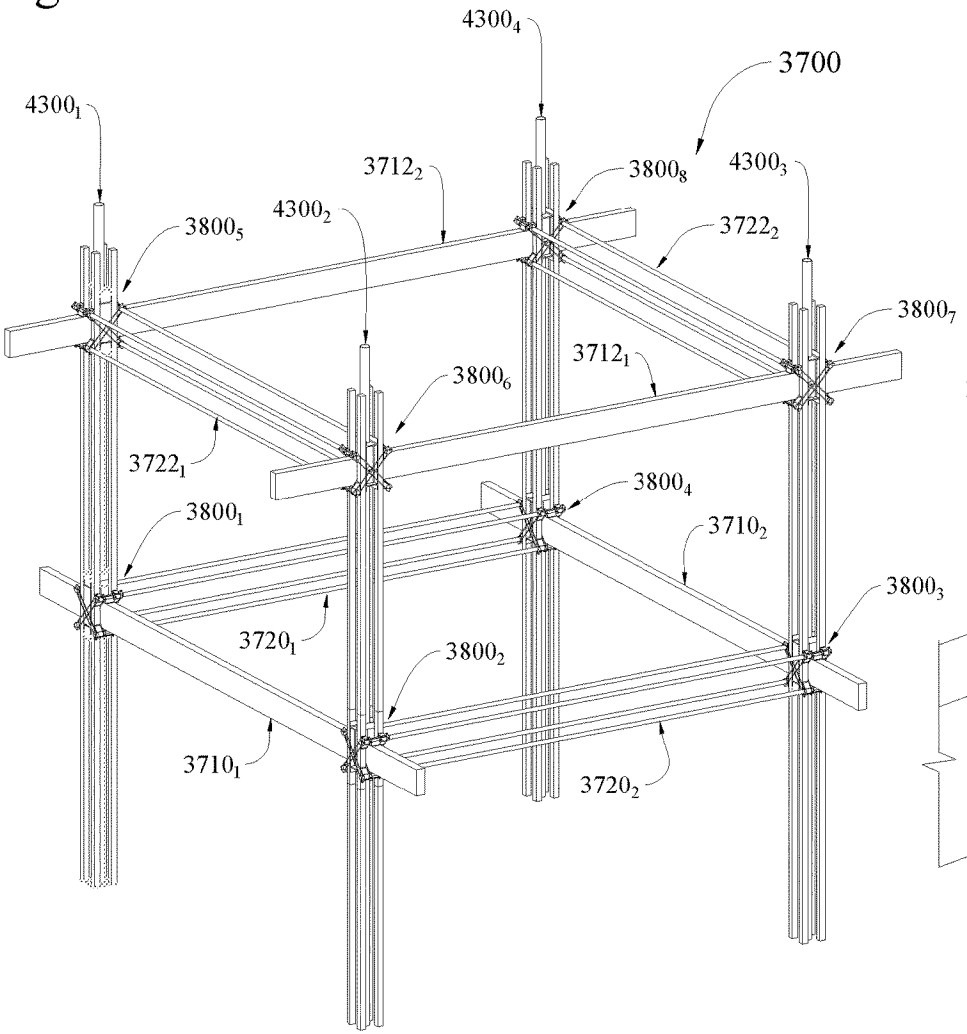
FIG. 37 illustrates a multi-level moment frame structure is shown according to one embodiment.

Referring now to FIG. 37, a multi-level moment frame structure is shown according to one embodiment. The double RBR connector joint with members as shown in FIG. 38 is used to form the multi-level moment frame structure shown in FIG. 37. There are eight (8) joints with members designated $\mathbf{3800}_1$-$\mathbf{3800}_8$. Each corner has four outside moment carrying columns which could be wood and one central vertical load carrying columns which could be steel designated by $\mathbf{4300}_1$-$\mathbf{4300}_4$.

Referring to FIG. 38, a first corner joint connection of the structure illustrated in FIG. 37 is shown according to one embodiment. FIG. 38 shows one joint of FIG. 37 formed by two RBR connectors with four outside columns $\mathbf{3810}_1$-$\mathbf{3810}_4$, one vertical load carrying column 4300, one beam $\mathbf{3712}_2$ and two sets of long block shafts $\mathbf{3812}_1$-$\mathbf{3812}_2$ and $\mathbf{3814}_1$-$\mathbf{3814}_2$.

Figure 39:
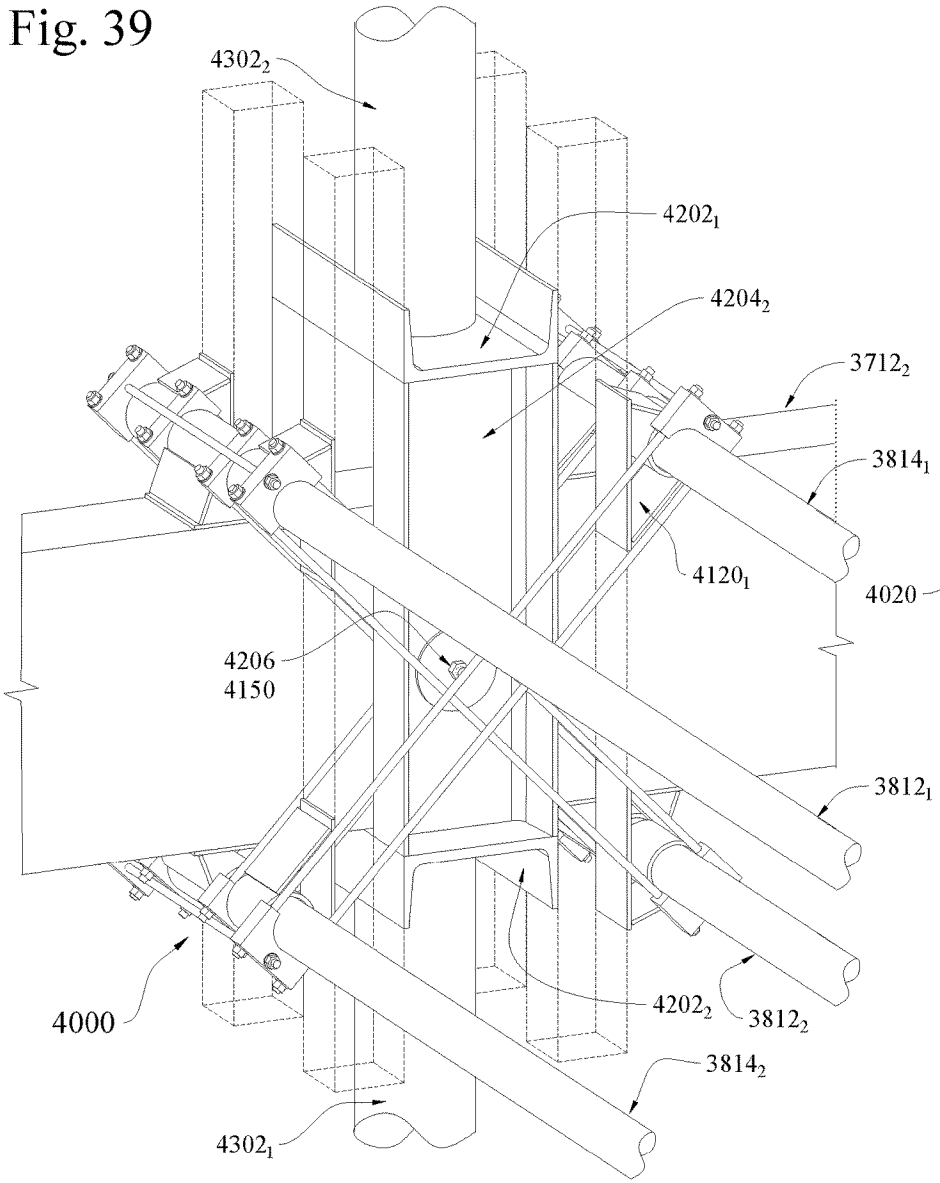
FIG. 39 shows the first corner joint connection of FIG. 38 with four vertical moment carrying members illustrated as dotted lines for clarity purposes according to one embodiment.

Referring to FIG. 39, the first corner joint connection of FIG. 38 with four vertical moment carrying members illustrated as dotted lines for clarity purposes is shown according to one embodiment. The first corner joint connection is shown as a double RBR connector joint, as discussed above. The columns are spaced apart by the width distance of $\mathbf{4204}_2$ and are installed between the column blocks such as $\mathbf{4120}_1$ and $\mathbf{4204}_2$. The beam $\mathbf{3712}_2$ bear onto $\mathbf{4202}_2$ to transfer all its vertical load to column $\mathbf{4302}_1$. The hole 4206 for pin 4150 is elongated vertically for it not to carry any vertical load.

Figure 40:
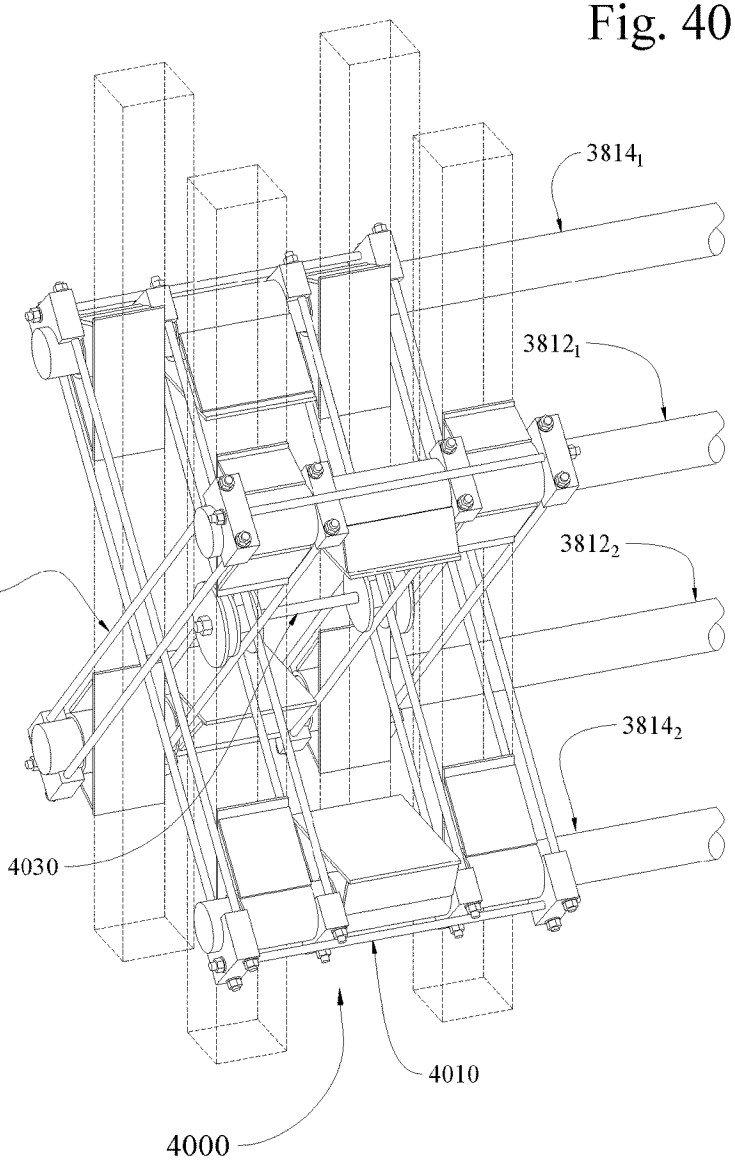
FIG. 40 shows the first corner joint connection of FIG. 39 with four vertical moment carrying members, a vertical load carrying column and a horizontal beam illustrated as dotted lines for clarity purposes according to one embodiment.

Referring to FIG. 40, the first corner joint connection of FIG. 39 with four vertical moment carrying members, a vertical load carrying column and a horizontal beam illustrated as dotted lines for clarity purposes is shown according to one embodiment. FIG. 40 shows the double RBR connector of FIG. 38 excluding all columns and beam to show 8 sets of linkage 4020 and center pin 4030 with internal bearing washers $\mathbf{4152}_1$-$\mathbf{4152}_2$ shown in FIG. 41. A connector with multiple sets of linkage can use smaller diameter linkage rods and block shaft by distributing the loads throughout the joint width rather than just at the ends.

Figure 41:
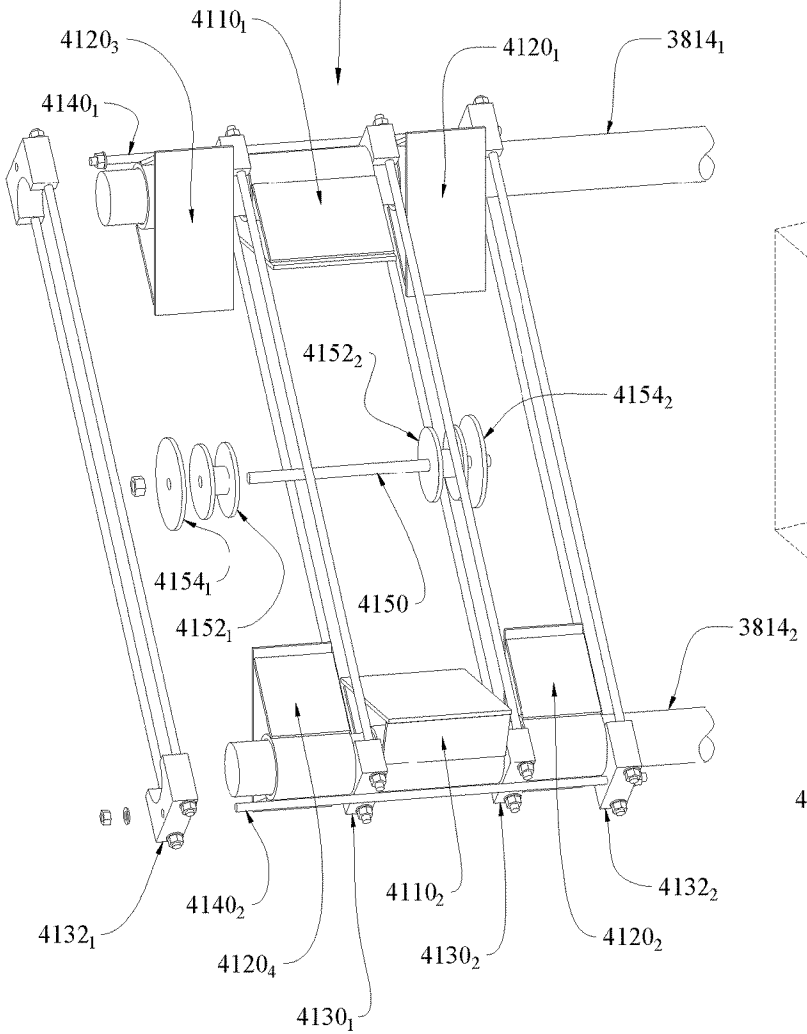
FIG. 41 shows a single RBR connector with four 2-bar linkages, a transverse clamp and a center pin having interior member bearing washers coupled with extended block shafts according to one embodiment.

Referring now to FIG. 41, a single RBR connector with four two-bar linkages, a transverse clamp and a center pin having interior member bearing washers coupled with extended block shafts is shown according to one embodiment. FIG. 41 shows one RBR connector of FIG. 38 consisting of linkage assemblies $\mathbf{4132}_1$-$\mathbf{4132}_2$ having transverse channels for transverse rods $\mathbf{4140}_1$-$\mathbf{4140}_2$ that hold linkages $\mathbf{4130}_1$-$\mathbf{4130}_2$, the column blocks $\mathbf{4120}_1$-$\mathbf{4120}_4$ and the beam blocks $\mathbf{4110}_1$-$\mathbf{4110}_2$ from spreading. The bearing washers $\mathbf{4152}_1$-$\mathbf{4152}_2$ are, e.g., spool shaped (e.g., a center component flanked by two outer components), to each have a large surface clamping bearing area with center to fit linkage rod spacing and diameter. The saddle rod hole centers are offset on the linkages so that the linkage is reversed between primary and secondary RBR connectors for the linkage rods to be on a different plane and not interfere with each other.

Figure 42:
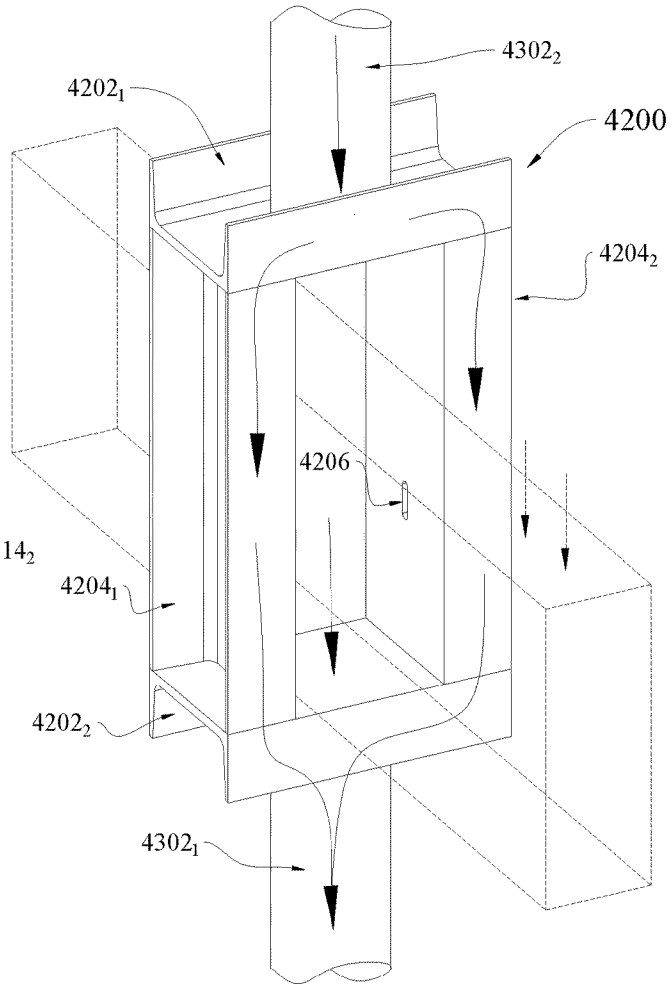
FIG. 42 shows beam-pass-through, a fabrication used as a channel of the central load bearing column located as shown in FIG. 43 for a beam to pass through according to one embodiment.

Referring now to FIG. 42, a beam-pass-through member 4200 installed at each vertical level for column 4300 used for transferring vertical beam loads through column 4302 lengths welded to the top component $\mathbf{4202}_1$ and the bottom component $\mathbf{4202}_2$ is shown according to one embodiment. The depth for component 4204 is determined by the column spacing; the width is determined from the width of the columns, beam and linkage saddles and the height is determined from the beam depth, the column block geometry and assembly requirements. An aperture 4206 is made in the components $\mathbf{4204}_1$-$\mathbf{4204}_2$ for installing the column to beam pin 4150 and made elongated vertically for the entire load on the beam to be carried by $\mathbf{4202}_2$ and not by the pin (e.g., the pin 4150). In one embodiment, the aperture 4206 is an oblong hole configured to receive the pin 4150. The opening of the aperture 4206 is configured to be greater than the diameter of the pin 4150 such that load is not transferred to the pin 4150. The vertical members $\mathbf{4302}_1$-$\mathbf{4302}_2$ are configured to carry vertical axial loads only and not have horizontal bending loads transferred thereto. The four other members $\mathbf{3810}_1$-$\mathbf{3180}_4$ are restrained by an RBR connector, e.g., the RBR connector 4100 of FIG. 41, and need to resist only bending loads. As is illustrated, the beam-pass-through member 4200 is sized specifically such that a gap is formed between the component $\mathbf{4202}_1$ and the beam. The beam end vertical loads are transferred to the column $\mathbf{4302}_1$ via the beams $\mathbf{3710}_1$-$\mathbf{3170}_2$ and $\mathbf{3712}_1$-$\mathbf{3172}_2$ resting on member $\mathbf{4202}_2$ of the beam-pass-through member 4200 at each level of the multilevel structure 3700 of FIG. 37. This method avoids vertical load transfer of an upper floor through the lower beams to avoid excessive bearing forces that could crush the lower beams.

Figure 43:
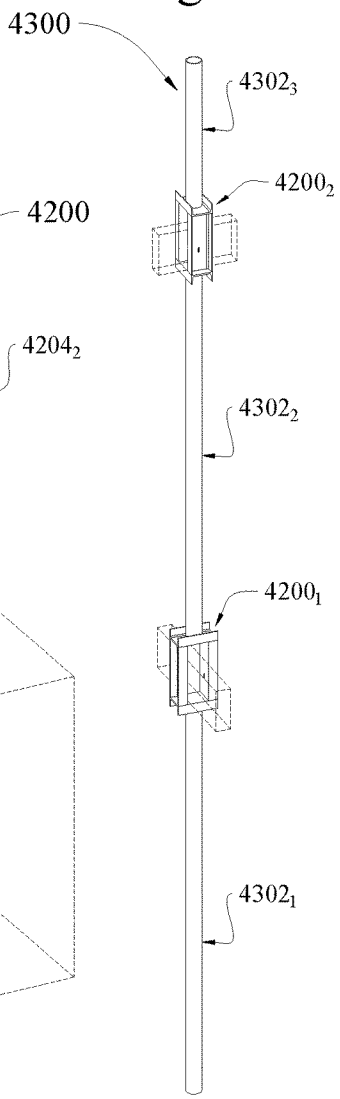
FIG. 43 shows a central load bearing column used for the frame structure shown in FIG. 37 according to one embodiment.

Finally, referring to FIG. 43, a vertical central load carrying column 4300 consisting of the column sections $\mathbf{4302}_1$-$\mathbf{4302}_3$ with a "beam-pass-through" configurations $\mathbf{4200}_1$-$\mathbf{4200}_2$ welded between these column sections, wherein the aperture of the beam-pass-through configuration $\mathbf{4200}_1$ extends in a first plane and the aperture of the beam-pass-through configuration $\mathbf{4200}_2$ extends in a second plane. In one embodiment, the second plane is perpendicular to the first plane. While FIG. 43 illustrates the first and second planes being perpendicular, other configurations have been contemplated.

Although the subject matter has been described in language specific to structural features or acts, it is to be understood that the subject matter defined in the appended claims is not necessarily limited to the specific features or acts described above. Rather, the specific features and acts described above are disclosed as examples of implementing the claims, and other equivalent features and acts are intended to be within the scope of the claims.

What is claimed is:

1. A rolling block restraint connector for forming a moment resisting connection at a joint intersection between a continuous column and at least a first continuous beam that intersects the continuous column, the connector comprising:

a first restraint assembly including (i) a first beam pressure block, (ii) a first column pressure block, and (iii) a first tubular shaft that passes through tubular channels of the first beam pressure block and the first column pressure block;

a second restraint assembly including (i) a second beam pressure block, (ii) a second column pressure block, and (iii) a second tubular shaft that passes through tubular channels of the second beam pressure block and the second column pressure block, wherein the second restraint assembly is configured to be located diagonally across the joint intersection from the first restraint assembly;

a first linkage that couples the first restraint assembly with the second restraint assembly, the first linkage including (i) a first saddle configured to couple with an exterior of a first end of the first tubular shaft, and (ii) a second saddle configured to couple with an exterior of a first end of the second tubular shaft; and a second linkage that couples the first restraint assembly with the second restraint assembly.

2. The connector of claim 1, wherein the first linkage includes a plurality of rods configured to couple the first saddle with the second saddle.

3. The connector of claim 1, wherein the second linkage includes (i) a third saddle configured to couple with an exterior of a second end of the first tubular shaft and (ii) a fourth saddle configured to couple with an exterior of a second end of the second tubular shaft.

4. The connector of claim 3, wherein the second linkage includes a plurality of rods configured to couple the third saddle with the fourth saddle.

5. The connector of claim 3, further comprising:

a first rod configured to couple the first saddle with the third saddle.

6. The connector of claim 5, further comprising:

a second rod configured to couple the second saddle with the fourth saddle.

7. The connector of claim 1, wherein the first restraint assembly includes a third beam pressure block, and wherein the second restraint assembly includes a fourth beam pressure block.

8. The connector of claim 1, wherein the second linkage is configured to be located on an opposite side of the continuous column relative to the first linkage.

9. The connector of claim 1, wherein the first column pressure block has a rectangular shape.

10. The connector of claim 1, wherein the first column pressure block includes a curved surface configured to contact the continuous column and a flat surface configured to contact the first continuous beam.

11. The connector of claim 1, further comprising:

a beam insert configured for placement in between the first continuous beam and the first beam pressure block.

12. The connector of claim 1, wherein one or more of the first tubular shaft or the second tubular shaft are configured to couple with one or more restraint assemblies of a second rolling block restraint connector.

13. A connecting system, comprising:

a beam-pass-through member configured to couple a first column component with a second column component, the beam-pass-through member including two vertical components and two horizontal components, wherein an aperture is formed therebetween, the aperture configured to receive a continuous beam; and a rolling block restraint connector for forming a moment resisting connection at a joint intersection between the first column component, the second column component and the continuous beam, the connector comprising:

a first restraint assembly including (i) a first beam pressure block, (ii) a first column pressure block, and (iii) a first tubular shaft that passes through tubular channels of the first beam pressure block and the first column pressure block, a second restraint assembly including (i) a second beam pressure block, (ii) a second column pressure block, and (iii) a second tubular shaft that passes through tubular channels of the second beam pressure block and the second column pressure block, wherein the second restraint assembly is configured to be located diagonally across the joint intersection from the first restraint assembly, a first linkage that couples the first restraint assembly with the second restraint assembly, the first linkage including (i) a first saddle configured to couple with an exterior of a first end of the first tubular shaft, and (ii) a second saddle configured to couple with an exterior of a first end of the second tubular shaft, and a second linkage that couples the first restraint assembly with the second restraint assembly.

14. The connecting system of claim 13, wherein the aperture has a rectangular shape.

15. The connecting system of claim 13, wherein the two vertical components and the two horizontal components are configured to transfer a first load from the first column component to the second column component.

16. The connecting system of claim 15, wherein the two vertical components and the two horizontal components are further configured to transfer a second load from the continuous beam to the second column component.

17. The connecting system of claim 13, wherein the first column pressure block is configured to abut a first continuous column and the second column pressure block is configured to abut a second continuous column, wherein the first continuous column and the second continuous column are parallel to the first column component and the second column component.

18. The connecting system of claim 13, wherein the first linkage includes a plurality of rods configured to couple the first saddle with the second saddle.

19. The connecting system of claim 13, wherein the second linkage includes (i) a third saddle configured to couple with an exterior of a second end of the first tubular shaft and (ii) a fourth saddle configured to couple with an exterior of a second end of the second tubular shaft.

20. The connecting system of claim 19, wherein the second linkage includes a plurality of rods configured to couple the third saddle with the fourth saddle.

* * * * *